US012576479B2

(12) United States Patent
Nguyen et al.

(10) Patent No.: US 12,576,479 B2
(45) Date of Patent: Mar. 17, 2026

(54) APPARATUS, METHODS, AND SYSTEMS FOR ABRASIVE BLASTING

(71) Applicant: Axxiom Manufacturing, Inc., Fresno, TX (US)

(72) Inventors: Phuong Taylor Nguyen, Richmond, TX (US); Jeffrey Wayne Hummel, Alvin, TX (US)

(73) Assignee: Axxiom Manufacturing, Inc., Fresno, TX (US)

( * ) Notice: Subject to any disclaimer, the term of this patent is extended or adjusted under 35 U.S.C. 154(b) by 580 days.

(21) Appl. No.: 18/073,225

(22) Filed: Dec. 1, 2022

(65) Prior Publication Data

US 2023/0173640 A1 Jun. 8, 2023

Related U.S. Application Data

(60) Provisional application No. 63/286,547, filed on Dec. 6, 2021.

(51) Int. Cl.

| | |
|---|---|
| ***B24C 9/00*** | (2006.01) |
| ***B24C 3/06*** | (2006.01) |
| ***B24C 5/02*** | (2006.01) |

(52) U.S. Cl.
CPC ..... *B24C 9/00* (2013.01); *B24C 3/062* (2013.01); *B24C 5/02* (2013.01)

(58) Field of Classification Search
CPC ..... B24C 5/04; B24C 5/02; B24C 7/0053
USPC ..... 451/102, 38, 101, 90, 92; 239/526
See application file for complete search history.

(56) References Cited

U.S. PATENT DOCUMENTS

| | | | | |
|---|---|---|---|---|
| 2,376,616 | A | 5/1945 | Oechsle et al. | |
| 4,593,858 | A * | 6/1986 | Pacht | B08B 3/026 251/30.05 |
| 4,728,205 | A | 3/1988 | Hasumi et al. | |
| 4,765,540 | A | 8/1988 | Yie | |
| 4,768,709 | A | 9/1988 | Yie | |
| 4,821,467 | A | 4/1989 | Woodson et al. | |
| 5,018,670 | A | 5/1991 | Chalmers | |
| 5,054,249 | A | 10/1991 | Rankin | |
| 5,201,150 | A | 4/1993 | Kuboyama et al. | |
| 5,407,379 | A | 4/1995 | Shank et al. | |
| 5,535,949 | A * | 7/1996 | Boisture | F16P 3/22 251/57 |

(Continued)

FOREIGN PATENT DOCUMENTS

| | | |
|---|---|---|
| DE | 102004023246 | 10/2005 |
| WO | 2009109017 | 9/2009 |

(Continued)

OTHER PUBLICATIONS

Journal of Protective Coatings and Linings, Technology Publishing Company (indicated publication or copyright 2015), see pp. 2-12 for spray wand.

*Primary Examiner* — Robert F Neibaur
(74) *Attorney, Agent, or Firm* — Kearney, McWilliams & Davis, PLLC; John M. DeBoer

(57) ABSTRACT

A carrier assembly for holding a hose that includes a main body having a first portion movingly engaged with a second portion. There is a guide rail disposed on at least one of the first portion, and the second portion. Either the first portion or the second portion is configured with a gripper element, and a latch.

20 Claims, 17 Drawing Sheets

(56) References Cited

U.S. PATENT DOCUMENTS

| | | | | |
|---|---|---|---|---|
| 5,636,789 | A * | 6/1997 | Shook | B05B 9/01 239/526 |
| 5,857,900 | A | 1/1999 | Shank, Jr. | |
| 5,904,297 | A | 5/1999 | Kendrick, Jr. et al. | |
| 6,168,503 | B1 | 1/2001 | Pao et al. | |
| 8,353,741 | B2 | 1/2013 | Fowler, III | |
| 9,138,863 | B2 | 9/2015 | Schubert et al. | |
| 9,364,868 | B2 * | 6/2016 | Bullard | B08B 3/028 |
| 2002/0083981 | A1 | 7/2002 | Thompson et al. | |
| 2009/0130959 | A1 | 5/2009 | Mase et al. | |
| 2015/0060567 | A1 | 3/2015 | Bullard et al. | |
| 2016/0236323 | A1 | 8/2016 | Mase et al. | |
| 2018/0130613 | A1 * | 5/2018 | Nguyen | H01H 13/506 |
| 2021/0001450 | A1 * | 1/2021 | Haverda | B24C 5/04 |

FOREIGN PATENT DOCUMENTS

| | | |
|---|---|---|
| WO | 2018055012 | 3/2018 |
| WO | 2021093978 | 5/2021 |

* cited by examiner 211
256
257
258
244b
255
244a
254
253
274
269a
271A
251a
251
272e
272d
273a
272c
273b
272b
250a
252a
266
265
264
279
280
276a
278
277
276
261
263
267
268
250B
260
267
263
252B
262
287
242
242c
215
269
240
270
271

APPARATUS, METHODS, AND SYSTEMS FOR ABRASIVE BLASTING

STATEMENT REGARDING FEDERALLY SPONSORED RESEARCH OR DEVELOPMENT

Not Applicable.

BACKGROUND

Field of the Disclosure

This disclosure generally pertains to abrasive blasting, with related apparatuses, methods, and systems, where the blasting may be wet, dry, or combinations thereof. More specifically, the disclosure relates to improved blast hose handling.

Background of the Disclosure

Abrasive blasting is the process of forcibly propelling a high pressure, high velocity stream of abrasive material against a surface. In this of process, a supply of sand (or other types of particles, such as grit or the like) is mixed with a fast-moving stream of air, usually in a mixer or valve. The sand particulate becomes entrained in the air, and the resultant air-sand mixture emerges at high speed from a nozzle at the end of a blast hose. Abrasive blasting is a physically laborious activity that raises musculoskeletal health concerns especially when using larger nozzles. The operator must control the hose in operation by gripping the hose tightly and simultaneously controlling the nozzle reactive back thrust using arms and torso.

When blasting at high pressures (100 psi or more), the abrasive discharge can reach speeds in excess of 500 mph, which means a high amount of thrust (force) may impact and be felt by an operator upwards of 20 to 30 lbs. Generally speaking, an abrasive spray operation may require long periods of spraying, where the ongoing thrust force quickly results in fatigue. Human nature results in moving or otherwise holding the blast hose in as comfortable position as possible, even if it results in an unsafe position.

For example, the operator may bend the blast hose against his/her body and create a blast hose arc angles greater than 90 degrees, which may result in a hose wear point. If the hose wears through, the abrasive may injure the operator. Bending the hose creates another source of force on the arms and shoulders particularly with larger hoses used for larger nozzles. Another common occurrence from fatigue is where the operator increases abrasive flow to decrease air flow (increased friction) to reduce back thrust which leads to increased cost and waste. Fatigue and/or injury also result in decreased productivity.

A need exists in the art for an abrasive blasting system and process that is easy to use, quick to install, and may move or reallocate thrust to areas of the body that have greater endurance. Such a configuration may greatly reduce strain on hands and arms. Additionally, a need exists to move thrust closer to center of the torso in order to reduce rotational torso strain.

SUMMARY

Embodiments of the disclosure pertain to an abrasive blasting system that may include any of: a blast hose; and a deadman assembly operably coupled directly or indirectly with the blast hose. Any discharge from the blast hose may depend on the position of the deadman assembly. The deadman assembly may include or otherwise be coupled with a carrier assembly. The deadman assembly may be indirectly coupled with the blast hose via the carrier assembly.

Still other embodiments of the disclosure pertain to a thrust management system. The thrust management system may be utilized for an abrasive blasting operation; however, other modes of operation are possible, such as pressure washing or the like (for example, a firefighter holding a spray hose).

Additional embodiments of the disclosure pertain to a carrier assembly configured with a thrust management system.

Yet other embodiments of the disclosure pertain to a carrier assembly for holding a hose that may include one or more of: a main body having a first portion and a second portion (the portions may be configured to movingly engage with each other). The first and second portions may have respective guide rails thereon. For example, a first guide rail disposed on the first portion and/or a second guide rail disposed on the second portion.

The carrier assembly may include a thrust management device coupled therewith. The device may have a pad mount having a pad coupled therewith. The carrier assembly or hose may have a deadman coupled therewith. For example, the deadman assembly may be coupled with one of the guide rails.

There may be a latch and a latch slot. The latch may be disposed on a side of the first portion. There may be a latch slot disposed on a respective side of the second portion. The latch may have a latch end configured for engaging with the latch slot. The latch may be rigid or elastic. There may be a first rigid latch, and there may be a first elastic latch.

The main body may have longitudinal body axis. There may be a secondary handle comprising a longitudinal handle axis, which may be coupled with either of the guide rails. The longitudinal body axis and the longitudinal handle may be offset to each other by an absolute reference angle. In embodiments the angle may be in the range of 1 to 135 degrees. In particular embodiments the angle may be in the range of 1 degree to 90 degrees. In other embodiments, the range may be 45 degrees to 135 degrees.

The pad mount may include a pad mount extension. The pad may be mated with a pad backing configured with a pad extension. The pad mount extension and the pad extension may be coupled together via a pliable coupler. There may be one or more (alignment) clamps disposed around the pliable coupler.

In the event a deadman assembly is used, the deadman assembly may be operable in a multi-position, multi-function configuration. These configurations may include one or more of: a blast mode, a no-blast mode, a no-blast, a nozzle-vent mode, etc. The deadman assembly may include one of an electric or pneumatic power and control configuration. Other modes of deadman assembly operation may include, for example, fiber optic.

At least one of the first portion and the second portion may include a barb adapter or gripper module coupled therewith. The barb adapter or gripper module may have an at least one barb or gripper for engaging the hose.

Embodiments herein may pertain to use of a thrust management system, such as for use on a pressurized hose. The thrust management system may include a pad mount configured to couple with the pressurized hose, the pad mount comprising a pad coupler extension. There may be a pad backing comprising a pad backing extension. There may be a coupler having a first coupler end coupled with the pad coupler extension. The coupler may have a second end coupled with the pad backing extension. The coupler may be durable, flexible component. The coupler may be made of a different material from that of the pad mount and the pad extension.

There may be a pad coupled with the pad backing. In aspects, the pad backing may have a thickness profile whereby an edge pad backing thickness is less than a middle pad backing thickness.

The pad mount may have one or more elongated portions, such as a first elongated portion and a second elongated portion. The pad mount may have and one or more support members. Any support member may be disposed respective elongated portions.

The first elongated portion may have a first portion longitudinal axis. The second elongated portion may have a second portion longitudinal axis. The first portion longitudinal axis and the second portion longitudinal axis may be at an offset from each other. The angle of offset may be about 1 degree to about 20 degrees. In aspects, the angle of the offset may be in a range of about 5 degrees to about 15 degrees. A ratio of thickness of the middle pad backing thickness to the end pad backing thickness may be in a range of 0.5 to 4. For example, the ratio may be about 1.5 to 2.5, or the ratio may be about 1.2 to 4.

The hose may be configured with a carrier assembly disposed thereon. The hose may be pressurized or configured to be pressurized. The hose may have a central hose axis. The pad may have a central pad axis. In lateral cross-section on a lateral x,y reference the central pad axis may be offset from the central hose axis by an x in a range of 3 to 5 inches, and a y in a range of 1 to 3 inches. Either offset may be in the range of 1 inch to 15 inches.

The pad may be configured with a first curvilinear side, a second curvilinear side, a first rounded corner, and a second rounded corner.

These and other embodiments, features and advantages will be apparent in the following detailed description and drawings.

BRIEF DESCRIPTION OF THE DRAWINGS

A full understanding of embodiments disclosed herein is obtained from the detailed description of the disclosure presented herein below, and the accompanying drawings, which are given by way of illustration only and are not intended to be limitative of the present embodiments, and wherein.

DETAILED DESCRIPTION

Figure 1A:
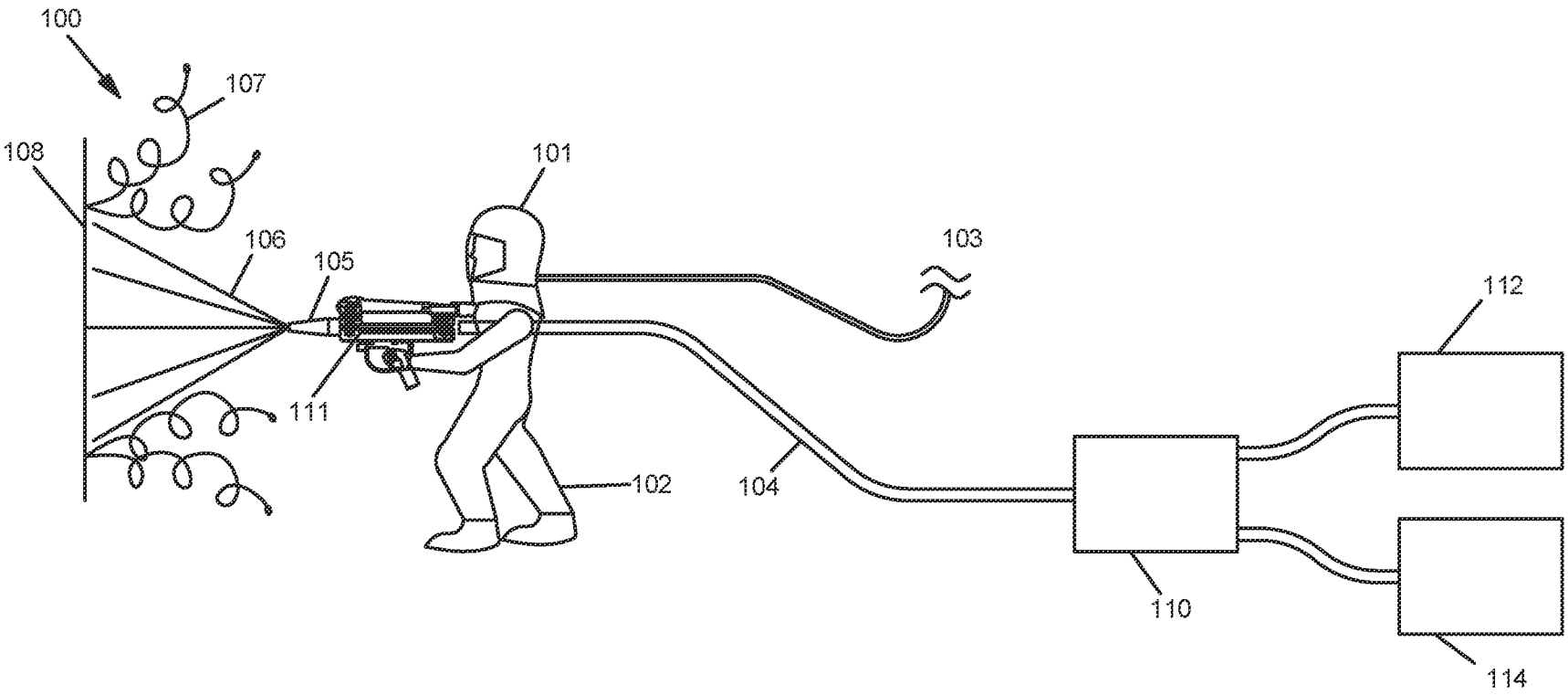
FIG. 1A shows a process diagram view of an abrasive blasting system in a blast mode according to embodiments of the disclosure.

Regardless of whether presently claimed herein or in another application related to or from this application, herein disclosed are novel apparatuses, units, systems, and methods that pertain to hose-use operations such as abrasive blasting, details of which are described herein.

Embodiments of the present disclosure are described in detail with reference to the accompanying Figures. In the following discussion and in the claims, the terms "including" and "comprising" are used in an open-ended fashion, such as to mean, for example, "including, but not limited to . . . ". While the disclosure may be described with reference to relevant apparatuses, systems, and methods, it should be understood that the disclosure is not limited to the specific embodiments shown or described. Rather, one skilled in the art will appreciate that a variety of configurations may be implemented in accordance with embodiments herein.

Although not necessary, like elements in the various figures may be denoted by like reference numerals for consistency and ease of understanding. Numerous specific details are set forth in order to provide a more thorough understanding of the disclosure; however, it will be apparent to one of ordinary skill in the art that the embodiments disclosed herein may be practiced without these specific details. In other instances, well-known features have not been described in detail to avoid unnecessarily complicating the description. Directional terms, such as "above," "below," "upper," "lower," "front," "back," etc., are used for convenience and to refer to general direction and/or orientation, and are only intended for illustrative purposes only, and not to limit the disclosure.

Connection(s), couplings, or other forms of contact between parts, components, and so forth may include conventional items, such as lubricant, additional sealing materials, such as a gasket between flanges, PTFE between threads, and the like. Various equipment may be in fluid communication directly or indirectly with other equipment. Fluid communication may occur via one or more transfer lines and respective connectors, couplings, valving, piping, and so forth. Fluid movers, such as pumps, may be utilized as would be apparent to one of skill in the art.

Numerical ranges in this disclosure may be approximate, and thus may include values outside of the range unless otherwise indicated. Numerical ranges include all values from and including the expressed lower and the upper values, in increments of smaller units. As an example, if a compositional, physical or other property, such as, for example, molecular weight, viscosity, melt index, etc., is from 100 to 1,000. it is intended that all individual values, such as 100, 101, 102, etc., and sub ranges, such as 100 to 144, 155 to 170, 197 to 200, etc., are expressly enumerated. It is intended that decimals or fractions thereof be included. For ranges containing values which are less than one or containing fractional numbers greater than one (e.g., 1.1, 1.5, etc.), smaller units may be considered to be 0.0001, 0.001, 0.01, 0.1, etc. as appropriate. These are only examples of what is specifically intended, and all possible combinations of numerical values between the lowest value and the highest value enumerated, are to be considered to be expressly stated in this disclosure. Numerical ranges are provided within this disclosure for, among other things, the relative amount of reactants, surfactants, catalysts, etc. by itself or in a mixture or mass, and various temperature and other process parameters.

Without limitation otherwise, the make and manufacture of any particular component, subcomponent, etc., described herein may be as would be apparent to one of skill in the art, such as molding, forming, press extrusion, machining, additive manufacturing, etc. Components, subcomponents, etc. may be metallic, plastic, composite, and so forth, and need not all be of the same material. Embodiments of the disclosure provide for one or more components to be new, used, and/or retrofitted to existing machines and systems.

For any embodiment of the disclosure, associated or auxiliary equipment including automation, controllers, piping, hosing, valves, wiring, nozzles, pumps, gearing, tanks, etc. may be shown only in part, or may not be shown or described, as one of skill in the art would have an understanding of coupling the components for operation thereof. Any component herein that utilizes power or automation may be provided with wiring, tubing, piping, etc. in order to be operable.

Terms

The term "connected" as used herein may refer to a connection between a respective component (or subcomponent) and another component (or another subcomponent), which may be fixed, movable, direct, indirect, and analogous to engaged, coupled, disposed, etc., and may be by screw, nut/bolt, weld, and so forth. Any use of any form of the terms "connect", "engage", "couple", "attach", "mount", etc. or any other term describing an interaction between elements is not meant to limit the interaction to direct interaction between the elements and may also include indirect interaction between the elements described.

The term "pipe", "conduit", "line", "tubular", "hose", or the like as used herein may refer to any fluid transmission means, and may (but need not) be tubular in nature. The term may also apply to other forms of transmission, such as electrical.

The term "composition" or "composition of matter" as used herein may refer to one or more ingredients, components, constituents, etc. that make up a material (or material of construction). Composition may refer to a flow stream of one or more chemical components.

The term "utility fluid" as used herein may refer to a fluid used in connection with the operation of an abrasive blasting device, such as a grit (sand), air, or water. The utility fluid may be for blasting, heating, cooling, or other type of utility. 'Utility fluid' may also be referred to and interchangeable with 'service fluid' or comparable.

The term "mounted" as used herein may refer to a connection between a respective component (or subcomponent) and another component (or another subcomponent), which may be fixed, movable, direct, indirect, and analogous to engaged, coupled, disposed, etc., and may be by screw, nut/bolt, weld, and so forth.

The term "non-emergency release" as used herein may refer to a voluntary release of a trigger/level mechanism of a deadman assembly in order to accomplish some other task, such as a break for shift change, a meal, or visit to a restroom, or to reposition for blasting a new area.

The term "deadman" as used herein may refer to an operable system or assembly utilizing some form of switch or comparable mechanism that, upon release of the 'deadman', results in shutdown. With respect to a blasting operation, release of the deadman may refer to a shutdown of media transfer through a blast line.

The term "control valve" as used herein may refer to a valve configured to control flow of a fluid, a solid, a slurry, etc. through the valve by varying the size of the flow passage as directed by a signal from a controller. The opening or closing of a control valve may be by electrical, hydraulic, or pneumatic actuators, or the like. The control valve may receive a signal from a deadman assembly in order to control other valves such as metering, combination or air valves.

The term "pneumatic" as used herein may refer to a device or piece of equipment operable or otherwise responsive to some form of air (or other suitable gas) pressure.

The term "metering valve" as used herein may refer to a type of valve associated with a solid, such as sand, grit, and the like. Such a valve may be multi-function. For example, the metering valve may control flow of the solid into a compressed air stream. Another function may be to regulate the solid flow by changing the orifice size in the valve body. The larger the orifice the greater the solids flow.

The term "pinch valve" or "pinch ram valve" may refer to a multi-direction (e.g., 2-way) valve operable to shut-off or control the flow of compressed air and/or corrosive, abrasive or granular media. The valve may utilize pressurized air to open or close. In the open position, the valve may have no restriction, and thus allows a wide range of compressed air and/or media to pass through its bore. The closed position may result in no flow through its bore. There may be a "shut off" valve.

The term "machined" may refer to a computer numerical control (CNC) process whereby a robot or machinist runs computer-operated equipment to create machine parts, tools and the like.

Figure 1B:
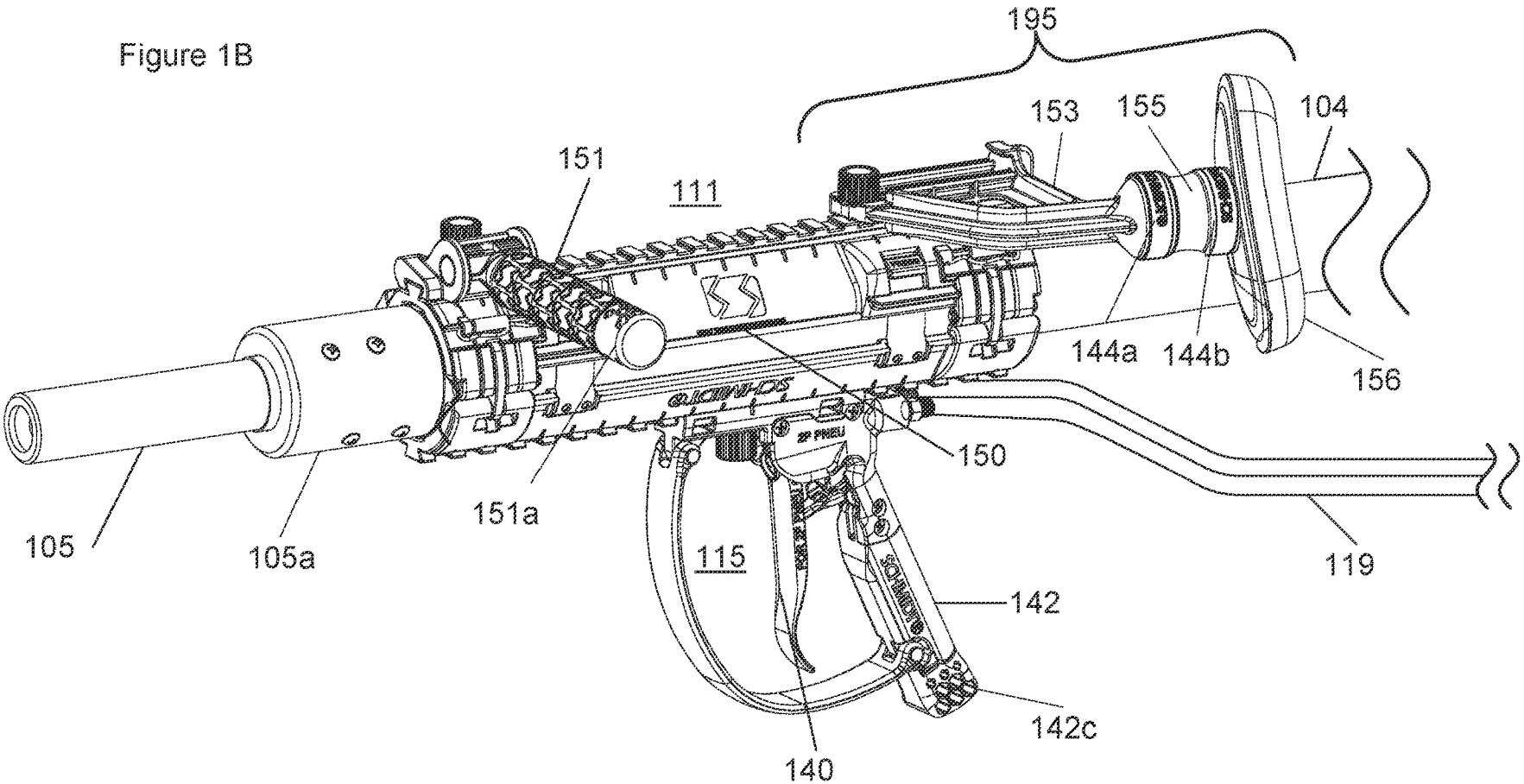
FIG. 1B shows a close-up prospective side view of a carrier assembly for a blast hose according to embodiments of the disclosure.

Referring now to FIGS. 1A, 1B, 1C, 1D, and 1E together, a process diagram view of an abrasive blasting system in a blast mode, a close-up prospective side view of a carrier assembly for a blast hose, a partial rear view of the carrier assembly of FIG. 1B engaged with the hose, a partial rear view of the carrier assembly of FIG. 1B with a body pad in a reversed side configuration, and a left side and right side body view of thrust impact to a body via use of a thrust management system, respectively, illustrative of embodiments disclosed herein, are shown.

FIG. 1A illustrates an embodiment of the abrasive blasting process (or system) 100, for which a supply of sand (or other types of particles, such as grit or the like) 114 may be mixed with a fast-moving fluid stream 112, usually in a mixer or valve 110. Although described by way of example as air, the fluid stream 112 may be other materials, such as water and the like. The sand particulate 114 may be entrained in the air 112, and the resultant air-sand mixture 106 emerges at high speed from a nozzle 105 at the end of a blast hose 104. The mixture 106 may be highly abrasive, and the blast 106 may remove even strongly-adhered compounds (e.g., paint, etc.) from a structural surface(s) 108.

The discharge of the air-sand mixture 106 may be hazardous for multiple reasons. First, particulate from the discharge, and as well as the blasted-surface, may linger in the air in the form of a cloud 107, making breathing difficult. As such, a breathing hood or suit 101 may be worn by an operator 102 (the suit 101 may be fed breathing air 103). However, the suit 101 does not provide for easy handling of the hose 104. As such, the operator 102 may utilize a carrier assembly 111.

Figures 1C, 1D:
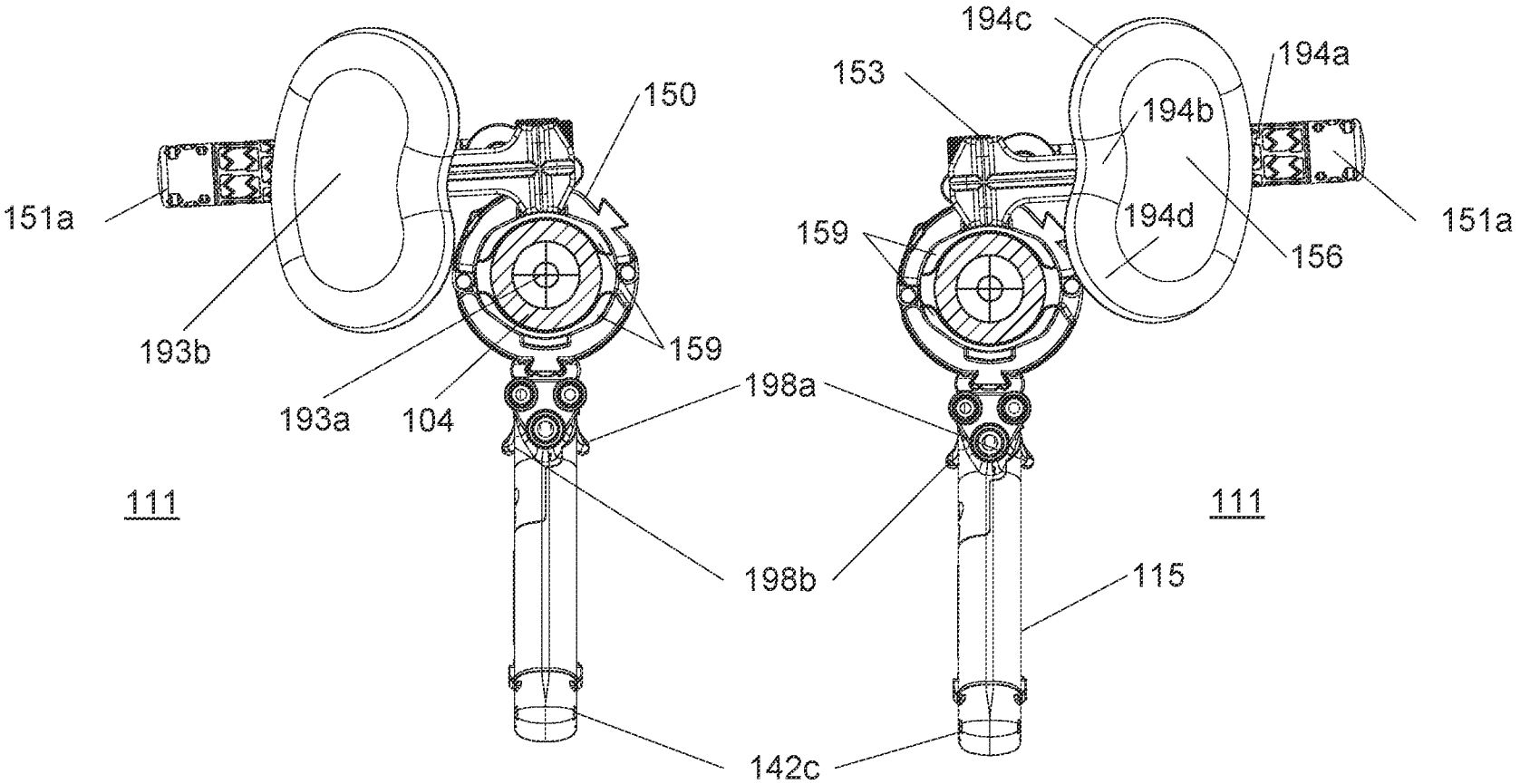
FIG. 1C shows a partial rear view of the carrier assembly of FIG. 1B engaged with the hose according to embodiments of the disclosure.
FIG. 1D shows a partial rear view of the carrier assembly of FIG. 1B with a body pad in a reversed side configuration according to embodiments of the disclosure.

As shown in FIGS. 1B-1D, the carrier assembly 111 may be an elongated tubular-type structure configured for mounting on and/or around the hose 104. The assembly 111 may have a casing (body) 150, which may have one or more integral or coupled subcomponents. The assembly 111 may have a 'clamshell' configuration suitable for closing around the hose 104. Although not necessary, the carrier assembly 111 may be mounted proximate to the nozzle 105 and nozzle holder 105*a*, as this positioning may give the operator 102 optimal control. The clamshell configuration may be created by lining up tabs on one part of the body 150 into slots into another part of the body, and creating a hinge point.

The carrier assembly 111 may have one or more associated components coupled therewith, such as a deadman assembly 115 and a secondary handle 151. Thus, the operator 102 need not hold the hose 104 directly, but instead may grasp the secondary handle 151, as well as the trigger 140/deadman handle 142 of the deadman assembly 115, thereby satisfying any "2 hands on" requirement. The deadman assembly 115 may be operable via wiring (or hose or other suitable mechanism) 119 and other related equipment not viewable here.

Curvature may be present in the frame 142 or trigger 140. It has been discovered that the curvature may provide an added amount of flexibility to the trigger 140 in the event the deadman is dropped. The bending moment may prevent breaking the trigger 140. Other impact mitigation features may be used, such as a handle bumper 151*a* or a deadman bumper 142*c*.

It has been further discovered that the use of a lock flap guard or sloped profile(s) 198 *a, b* may aid in the prevention of inadvertent activation of the deadman (and/or trigger 140). The sloped profile 198 *a, b* results in an overhang that eliminates or mitigates this possibility. The sloped profiles 198*a*, 198*b* may be symmetrical or redundant to each side of the frame 142.

The deadman assembly 115 may have a simple blast/no-blast configuration that may entail the trigger released or trigger squeezed; however, the deadman assembly 115 is not meant to be limited, and may have one or more other configurations or features, such as being modular, electric, pneumatic, single-function, multi-function, utilize an actuator, and require reduced force to activate. The deadman assembly may be as that of any embodiment in pending U.S. non-provisional application Ser. No. 17/241,466, filed Apr. 27, 2021, incorporated herein by reference in its entirety for all purposes.

FIGS. 1C and 1D together illustrate the carrier assembly 111 disposed around the hose 104, with one or more barbs or grippers 159 engaged thereagainst. To further aid the operator 102, the assembly 111 may have a chest or body pad 156, which may help dissipate forces and provide added comfortability. One of skill would readily appreciate the position of the pad 156 may be reversed simply by changing the orientation of a pad mount 153. As such the ambidextrous nature of the assembly 111 may be suitable for an operator with a dominant left or ride side; moreover, when the operator tires of holding the assembly in the configuration of 1C, he/she may stop and reconfigure the pad mount 153 and the pad 156 and hold the deadman 115 and handle 151 with opposite hands for the configuration of 1D, and vice versa.

The assembly 111 may have a thrust management system 195 coupled therewith. The thrust management system may include the pad mount 153 coupled with the pad 156 via a coupler 155. The pad mount 153 may be hard or rigid, whereas the pad 156 may be soft or pliable. The coupler 155 may be flexible, and thus accommodate bending moments during a spray or blast operation.

To aid attachment and alignment, each end of the coupler 155 may have a respective clamp disposed therearound. As shown here, the coupler 155 may have a first clamp 144*a* disposed therearound, and/or the coupler 155 may have a second clamp 144*b* disposed therearound.

The thrust management system 195 may be adept at shifting load or thrust from high pressure operations felt by the operator in a blast axis (or vector) 193*a* by displacing onto a thrust axis 193*b*. The thrust axis 193*b* may be offset from the blast axis 193*a*. With reference to an x, y grid on a lateral view, the offset in a suitable manner to accommodate a given operator body type. For example, the offset may be in an offset range of about 1 inch to about 15 inches along an x-axis (or horizontal), and/or may be about 1 inch to about 15 inches along a y-axis (or vertical). In embodiments, the offset may be about 3 inches to about 5 inches along the x-axis and/or about 1 inch to about 3 inches along the y-axis.

Figure 1E:
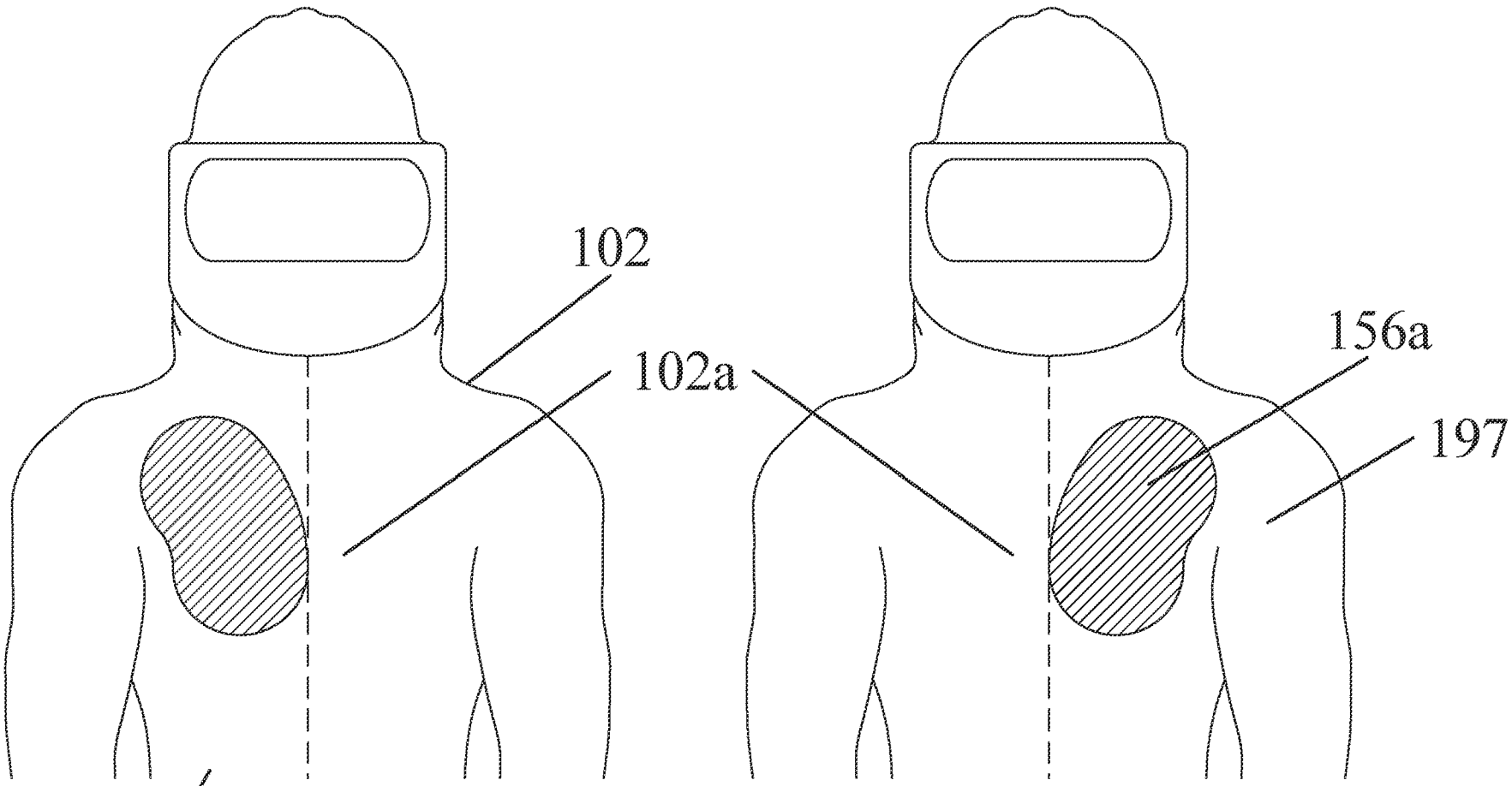
FIG. 1E shows a left side and right side body view of thrust impact to a body via use of a thrust management system according to embodiments of the disclosure.

FIG. 1E illustrates a silhouette 156*a* of thrust displacement and distribution onto a center mass 102*a* of the operator 102. The thrust management system 195 may be configured to displace and distribute as much force as possible into center mass 102*a* of a body 196. As the hands, arms, and armpit/shoulder area 197 of the body 196 are known to be full of nerves and other sensitive body parts, ligaments, etc., or otherwise may tire, the thrust management system 195 may be configured with the pad 156 having a suitable shape that circumnavigates this area.

Although not limited to any particular shape, the pad 156 may be asymmetrical in nature. For example, the pad 156 may have a pseudo-kidney bean shape. Thus, the pad 156 may have one or more curvilinear sides 194*a*, 194*b*. There may be rounded corners 194*c* and 194*d* that arc in an opposite direction from 194*a* and 194*b*. The asymmetrical curvilinear nature of the sides 194 *b-d* may provide the ability to avoid the armpit region of the operator 102. Just the same, the pad 156 may have a symmetrical or otherwise desired shape. The pad 156 may also provide a larger or smaller silhouette 156*a* compared to that shown by way of example here. It would be appreciated that the thrust management system 195 and/or the assembly 111 may be suitable for other operations than that of abrasive blasting. For example, the thrust management system 195 and/or the carrier assembly 111 may be used with pressure washing and the like. In the same vein, the thrust management system 195 need not be used with a deadman assembly 115.

Figure 1G:
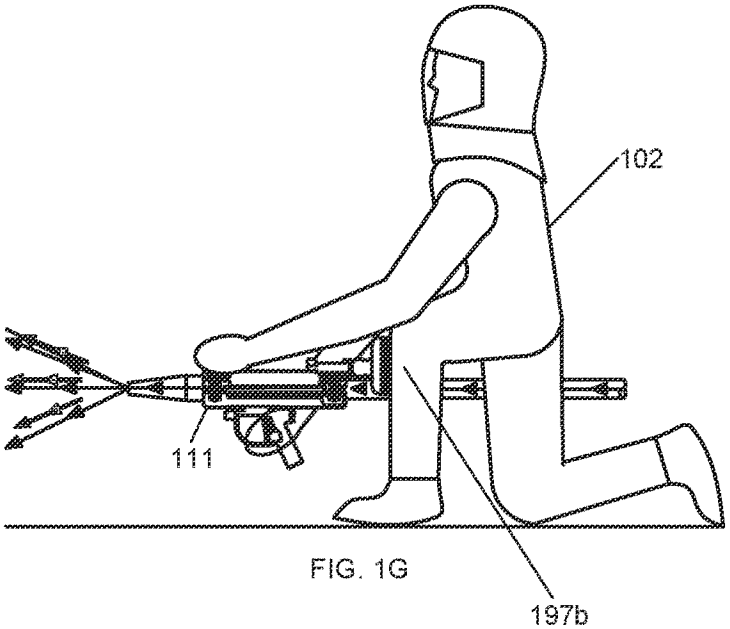
FIG. 1G shows a side body view of thrust impact to a lower leg portion of body via use of a thrust management system according to embodiments of the disclosure.
Figure 1F:
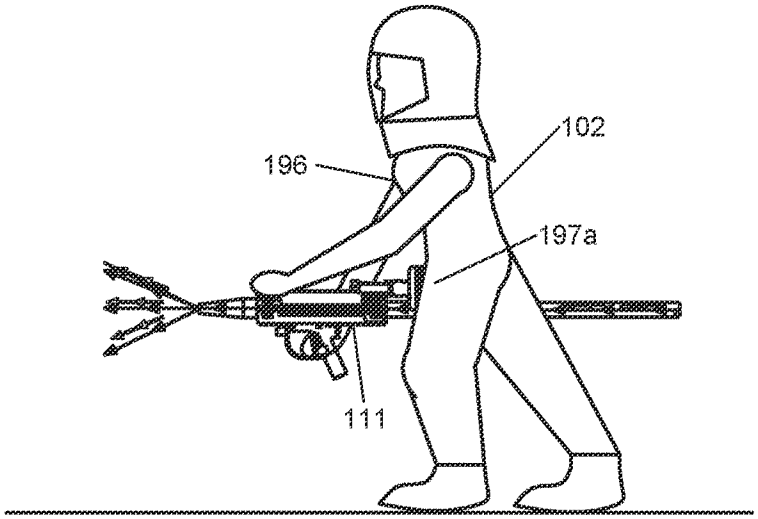
FIG. 1F shows a side body view of thrust impact to a hip or upper leg portion of body via use of a thrust management system according to embodiments of the disclosure.

Referring briefly to FIGS. 1F and 1G together, a side body view of thrust impact to a hip or upper leg portion of a body and a side body view of thrust impact to a lower leg portion of a body, respectively, via use of a thrust management system illustrative of embodiments disclosed herein, are shown.

FIGS. 1F and 1G illustrate the versatility of the carrier assembly 111, in that the operator 102 may utilize other areas of the body 196 that can safely and comfortably sustain the force for thrust distribution, such as a hip or upper leg portion 197*a* or a lower leg (e.g., shin) portion 197*b*. It is not always the case that the target surface is directly ahead, and the ability to have other angles of blast approach, or to reach traditionally difficult areas, is desirable.

Figure 2A:
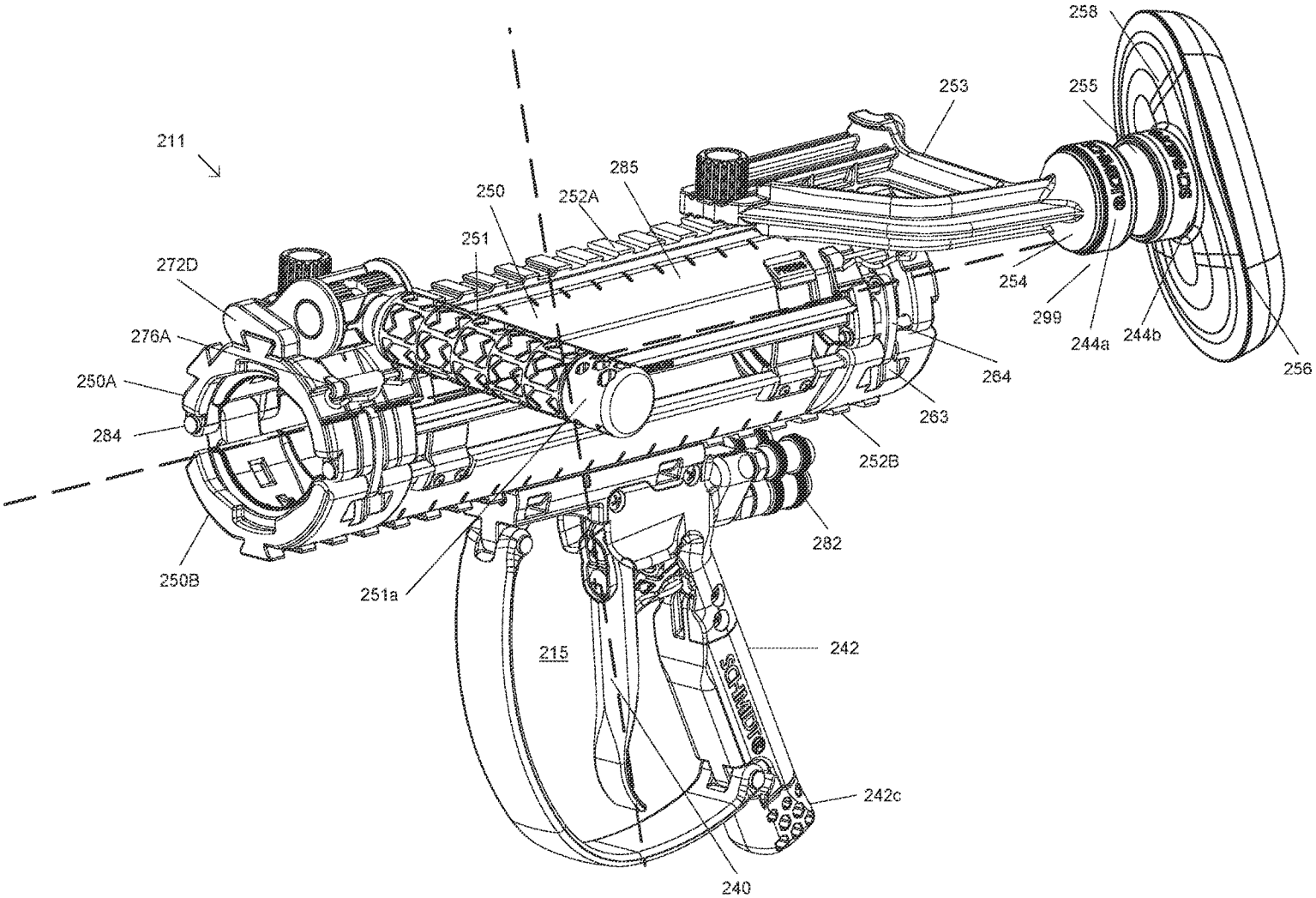
FIG. 2A shows a prospective side view of a closed carrier assembly for a hose according to embodiments of the disclosure.
Figure 2B:
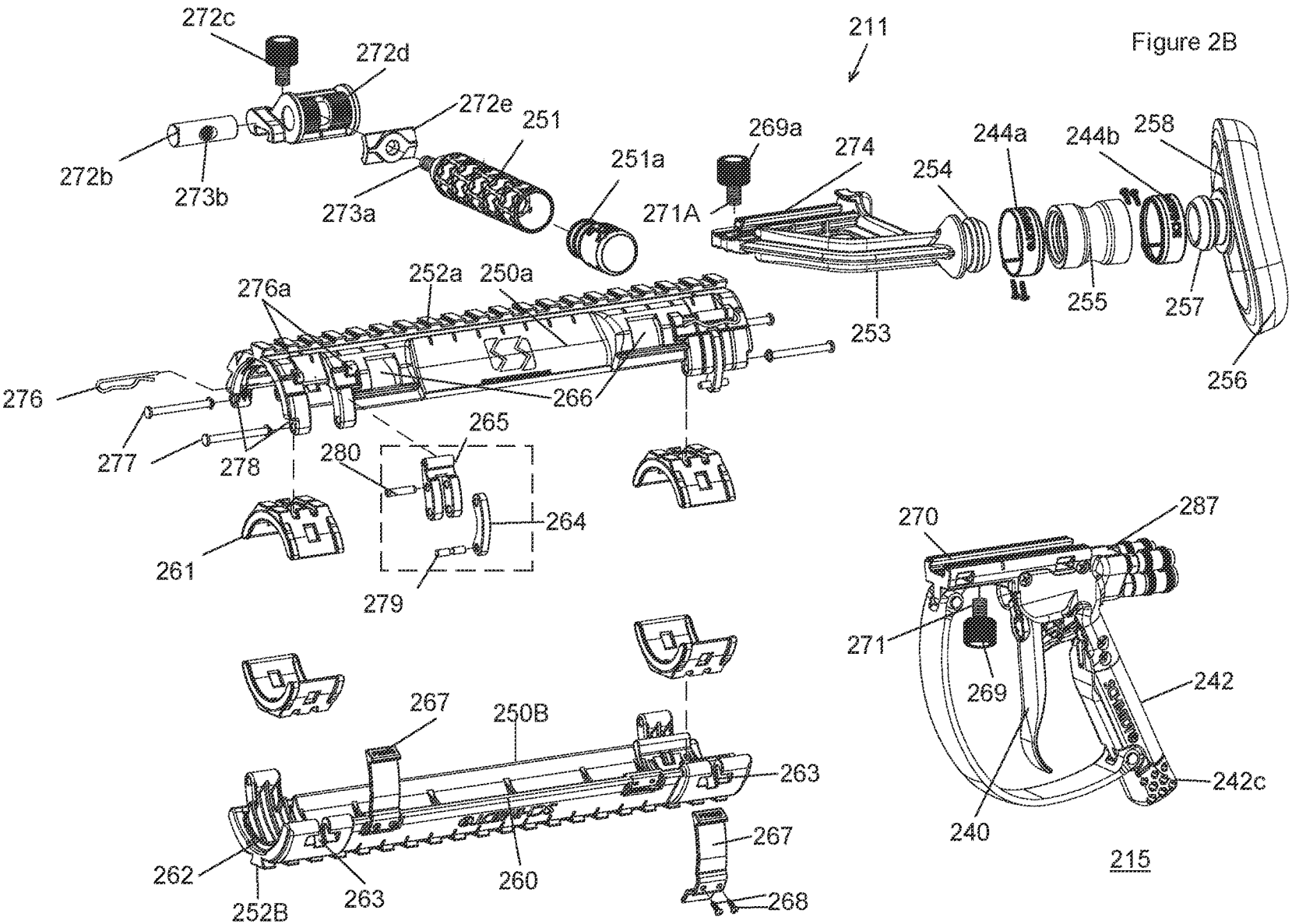
FIG. 2B shows a prospective side component breakout view of the assembly of FIG. 2A according to embodiments of the disclosure.

Referring now to FIGS. 2A and 2B together, a prospective side view of a closed carrier assembly for a hose, a prospective side component breakout view of the assembly of FIG. 2A, and a prospective side view of an alternative carrier assembly for a hose, respectively, illustrative of embodiments disclosed herein, are shown.

FIGS. 2A and 2B show a carrier assembly 211, which may be suitable for use with an abrasive blasting hose, or alternatively, any other kind of line or hose where a user may desire or need control and ergonomic impact consideration.

Although not limited to any particular shape, the carrier assembly 211 may have an elongated tubular body 250, where the tubular nature allows for a hose (e.g., 104) to fit therein. That said, the shape of the carrier assembly 211 is not limited to tubular, and other shapes and configurations are within the scope of the disclosure. As shown here, the body 250 may be made up of a first portion 250A movingly (such as hingedly) coupled with a second portion 250B. The portions 250 A/B may be coupled together via one or more pins (or comparable) 277 disposed within respective portion slots or holes 278. The assembly 211 may thus have freedom of movement (such as open and close) around assembly rotation point 284.

The assembly 211 may have one or more guide rails 252 A/B. For example, the first portion 250A may have a first guide rail 252A and/or the second portion 250B may have a respective guide rail 252B. The guide rails 252 A/B may be an elongated slot-type structure disposed or otherwise formed along an outer assembly surface 285 for the length of the portions; however, the guide rails 252 A/B need not extend the full length, and may be partial in length along the outer surface 285. It is within the scope of the disclosure that there may be other rails (not viewable here) to accommodate other positions and configurations for accessories to couple with the assembly 211.

The rails 252 A/B may be configured for one or more components to be coupled thereon. As illustrated, a secondary handle mount 272*d* may be coupled with the first rail 252A. There may be a secondary handle 251 integral to or coupled with the handle mount 272*d*. As shown here, the secondary handle 251 may be coupled with a mount sidewall 272*e* via a threaded handle end 273*a* that may mate with a receptacle 273*b* of an insert 272*b*. There may be a mount lock screw 272*c* disposed therethrough (the lock screw 272*c* engageable against the rail 252A). One of skill would appreciate the position of the secondary handle 251 may be reversable, such as by reversing the position of the handle mount 272*d* on the rail 252A.

Figure 5B:
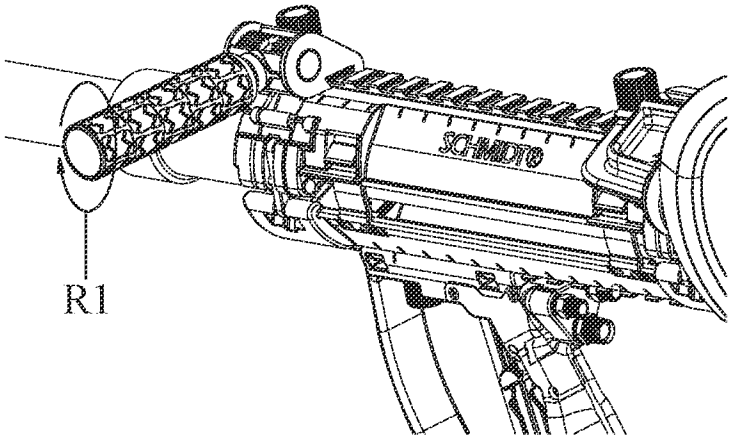
FIG. 5B shows a rearward side view of the secondary handle of FIG. 5A moved to a second position according to embodiments of the disclosure.
Figure 5A:
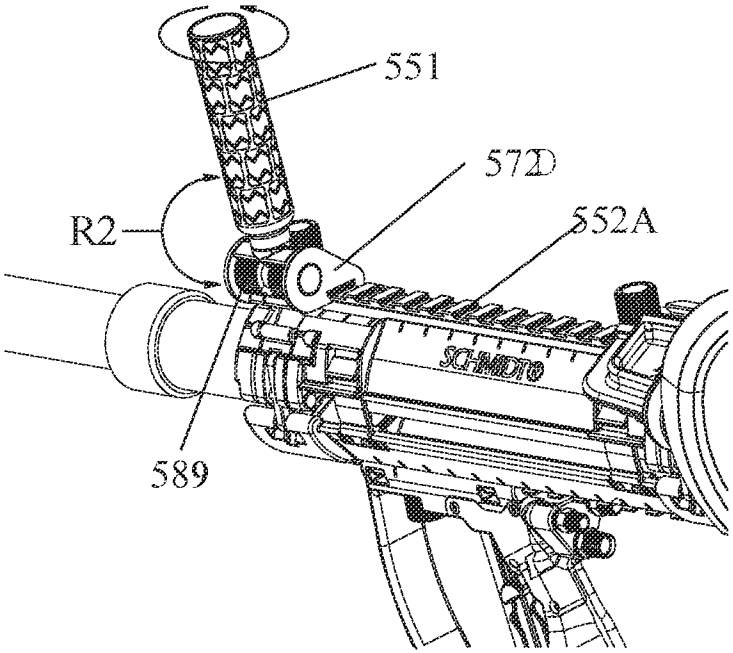
FIG. 5A shows a rearward side view of a secondary handle in a first position according to embodiments of the disclosure.

Referring briefly to FIGS. 5A and 5B together, a rearward side view of a secondary handle in a first position and a rearward side view of the secondary handle moved to a second, illustrative of embodiments herein, are shown.

FIGS. 5A and 5B together show an embodiment where a handle mount 572*d* may be stationary on a rail 552, yet a secondary handle 551 may be movable. For example, the secondary handle 551 may be movable from a first handle position (e.g., FIG. 5A) to a second handle position (e.g., FIG. 5B). The handle 551 may screw-tighten against mount teeth 589. To move the handle 551, the handle 551 may be rotated R1 (such as counterclockwise). Once moved to a desired position, the handle 551 may be (re)tightened by rotating R1 the other direction (e.g., clockwise). When loosened, the handle 551 may be rotatable around rotation point R2.

Returning again to FIGS. 2A and 2B, the secondary handle 251 may be rigid member configured for gripping and holding by a user, and although shown here as cylindrical, may be of any suitable shape or size. The secondary handle 251 may be configured for optimized (minimized) ergonomic impact, and readily allows a user (operator 102, etc.) to indirectly hold the hose or line in a comfortable position. The secondary handle 251 may be configured with gripping elements, such as foam, pre-formed finger grooves, etc. Of significance, the secondary handle 251 may have a longitudinal handle axis offset from a longitudinal axis of the body 250. In embodiments, the axes may be approximately perpendicular to each other. The longitudinal body axis and the longitudinal handle axis may be offset to each other by an absolute reference angle in the range of 1 degree to 135 degrees. In aspects, the range may be 45 degrees to 135 degrees.

There may be a pad mount 253 coupled with the first rail 252A. For example, the pad mount 253 may have a rail slot 274 (on either or both sides of the mount 253) configured to movingly (slidingly) engage the first rail 252A. Accordingly, the position of the pad mount 253 may be adjustable along the rail 252A, and the orientation of the pad mount 253 may be extended outwardly left or right.

The pad mount 253 may be releasably coupled with the first rail 252A in any suitable manner, such as via a twistable knob 269A having a lock screw 271A disposed therethrough (the lock screw 271A engageable against the rail 252A via a hole in the mount 253).

The pad mount 253 may have a pad 256 integral to or coupled therewith. As shown here, the pad mount 253 may have a coupler extension 254, which may provide the ability to couple any number of pad configurations (shapes, sizes, materials, etc.) to the assembly 211. The pad 256 may be pliable or deformable type material such as foam or rubber, and may be coupled (such as adhesively) to a pad backing 258. The pad backing 258 may have a pad extension 257.

The coupler extension 254 and the pad extension 257 may couple together directly, or in other embodiments indirectly, such as via a coupler or nipple 255. The components associated with the pad 256 and pad mount 253 may be configured to be durable, yet pliable in nature in order to provide a measure of comfort to the user by allowing the pad to self-orientate to a user's body by the flexibility of the coupler nipple 255.

Where the coupler 255 mates with the coupler extension 254, there may be a first clamp 244*a* disposed therearound. In a similar respect, where the coupler 255 mates with the pad extension 257, there may be a second clamp 244*b*. The clamps 244*a* and 244*b* may have a tight tolerance fit around the coupler. In aspects, the clamps 244*a* and 244*b* may have ends that tighten together via a screw and bracket 299.

The first clamp 244*a* and the second clamp 244*b* may help hold the coupler 255 sufficiently engaged to the coupler extension 254 and pad extension 257 without significantly changing the flexibility of the coupling in conjunction with the pad 256. This may help keep the thrust management system (e.g., FIG. 7A, 795) securely anchored to the body part that can safely and comfortably sustain the force of the nozzle thrust.

The pad 256 may absorb upwards of 90% of thrust and reduce physicality of the abrasive blast, especially with larger blast nozzles (e.g., >7/16" orifice) which may have more thrust. The pad backing 258 may be thicker and more rigid at center where thrust becomes concentrated. The pad backing 258 may be progressively thinner from the middle, where thrust may be concentrated, to the outer end, which may allow the pad 256 to conform to the user's chest shape and orientation of blast hose or nozzle.

As may be desired, there may be any number of other mounts coupled with the body 250, such as an auxiliary mount. Any such mount may attach the to the rails 252 A/B, such as by sliding, snapping, fastening, etc.

The carrier assembly 211 may have a deadman assembly 215 coupled therewith. Although not meant to be limited, the deadman assembly 215 may have a trigger 240/handle (or body) 242 configuration that may provide a user the ability to hold the deadman 215 on an axis offset from that of the blast hose.

Curvature may be present in the frame 242 or trigger 240. Other impact mitigation features may be used, such as a handle bumper 251*a* or a deadman bumper 242*c*. It has been further discovered that the use of a finger guard or sloped profile(s) may aid in the prevention of inadvertent activation of the deadman (and/or trigger 240). The sloped profile results in an overhang that eliminates or mitigates this possibility.

The deadman assembly 215 may have an upper end 287 configured with a deadman rail slot 270, which may accommodate moving (sliding) engagement onto the second guide rail 252B. The deadman 215 may be releasably coupled with the second rail 252B in any suitable manner, such as via a twistable knob 269 having a lock screw 271 disposed therethrough (the lock screw 271 engageable against the rail 252B via a hole in the deadman 215). Accordingly, the position of the deadman 215 may be adjustable along the rail 252B. Although not shown here, the deadman assembly 215 may operably coupled with peripheral equipment, such as a power source or control logic, via connection point 282.

As mentioned, the carrier assembly 211 may be configured for disposing around a blast hose or other comparable piece of equipment. To do so, the user simply separates or opens the portions 250 A/B in a sufficient manner to fit around the hose, etc., and then moves or closes the portions 250 A/B together with the hose (or a portion thereof) now disposed therein.

The inside or underside 260 of the carrier assembly 211 may engage with the hose. To provide added support and grip, there may be one or more gripper inserts 261 disposed within an adapter receptacle 262 of either or both of the portions 250 A/B. The inserts 261 may be secured within the receptable 262 via snapping, press-fit, securing members, combinations thereof, or other suitable coupling.

One or more ribs may be disposed on the respective gripper insert 261. The ribs may be integral, or coupled therewith. The ribs may be configured to engage the hose in a sufficient manner to prevent any significant longitudinal movement of the hose while disposed within the assembly 211. Just the same, the ribs need not prevent (some) rotation of the hose, and thus may provide a measured freedom of movement.

As the insert 261 may be removable, other sizes may be used in order to accommodate different sizes of hose. Thus, the gripper inserts 261 may correspond to different hose sizes. In aspects, the barbs on the insert 261 may keep a (blast) hose straight in the carrier assembly 211. It is worth noting that the insert 261 may be integral with the respective portion 250 A/B, and thus while referred to as 'gripper insert' could simply just be referred to as a gripper feature.

Referring briefly to FIGS. 8A, 8B, 8C, 8D, and 8E, a gripper insert having a gripper rib and a wear surface, a gripper insert having a gripper rib and an alignment guide rib, a snap-in gripper insert, a gripper insert having a lateral alignment guide, and a side profile view of a gripper insert having a wear indicator surface between two gripper ribs, respectively, illustrative of embodiments disclosed herein, are shown.

FIGS. 8A-8D together show various embodiments of a gripper module or insert 861 that may be useable with a carrier assembly (e.g., 211) of the present disclosure. FIG.

8A shows an insert with a body 861 having a first end 861*a* and a second end 861*b*, and the ends 861 *a, b* being adjoined by respective first side 861*c* and second side 861*d*. On either or both of the sides 861 *c, d* may be a gripper rib 835. The gripper rib 835 may extend partially or entirely between the first end 861*a* and the second end 861*b*. Akin to a barb (259, FIG. 2C), the gripper rib 835 may be useful to engage a hose in a sufficient manner to prevent any significant longitudinal movement of the hose. Just the same, the gripper rib 835 need not prevent (some) rotation of the hose, and thus may provide a measured freedom of movement.

To further or facilitate grip, either of the sides 861 *c, d* may have a plurality of gripper ribs 835. For example, on the first side 861*c*, there may be a first gripper rib 835*a* proximate to a second gripper rib 835*b*, with a space or region 838 therebetween. The space 838 between ribs 835 *a, b* may result in a wear indicator surface 836.

Figure 8C:
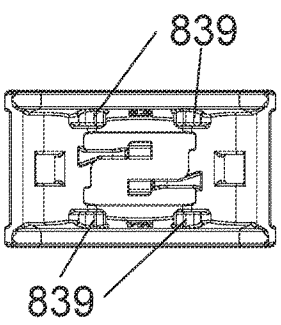
FIG. 8C shows a rotated profile view and a downward view of a snap-in gripper insert with at least one wear indicator according to embodiments of the disclosure.
Figure 8D:
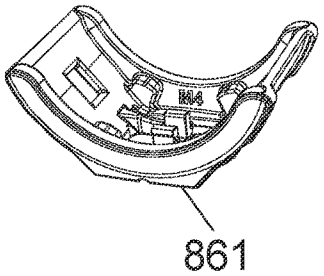
FIG. 8D shows a rotated profile view and a downward view of a gripper insert having a lateral alignment guide according to embodiments of the disclosure.
Figure 8D:
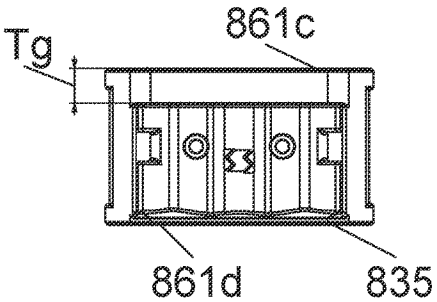
Figure 8A:
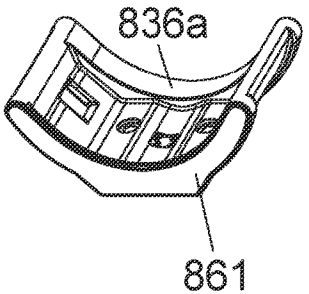
FIG. 8A shows a rotated profile view and a downward view of a gripper insert having a gripper rib and a wear indicator surface according to embodiments of the disclosure.
Figure 8A:
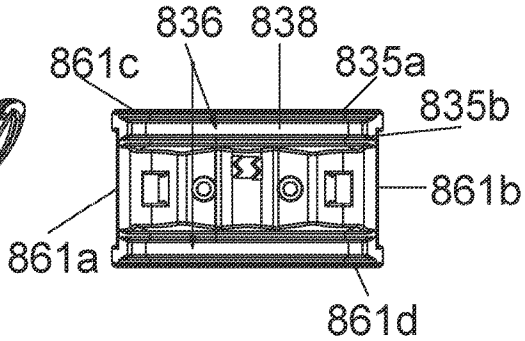
Figure 8A:
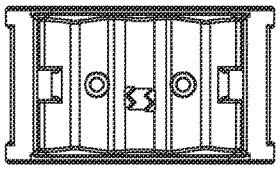
Figure 8A:
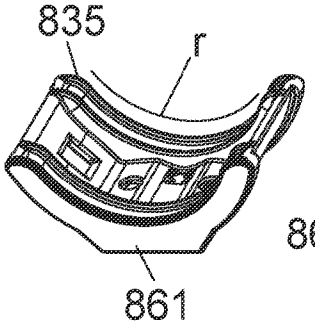
Figure 8B:
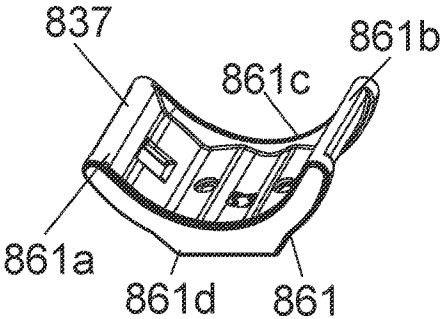
FIG. 8B shows a rotated profile view and a downward view of a gripper insert having a gripper rib and an alignment guide according to embodiments of the disclosure.
Figure 8E:
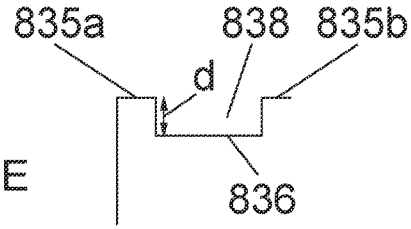
FIG. 8E shows a side profile view of a gripper insert having an alternate wear indicator surface between two gripper ribs according to embodiments of the disclosure

FIG. 8E shows the wear indicator surface 836 may be sunk or depressed a depth d from the tops of ribs 835 *a, b*. The depth d may be less than a cut depth that maintains the integrity of the hose (not viewable here), such that were the ribs 835 to cut into the hose, eventually the outer hose surface would rub against the wear indicator surface 836 making it difficult for the rib(s) 835 to cut any deeper into the hose. The additional benefit of the wear indicator surface 836 may be that it frays the hose in sufficient manner that is easily identifiable on inspection that the hose needs to be changed. Additional help may be provided from redundant ribs 835 *c, d* on the other side 861*d* of the gripper 861 (with respective wear indicator surface 836 therebetween). One of skill would appreciate the shape of any gripper rib 835 may be arcuate in nature, and thus any rib 835 may have a radius r associated therewith. The radius r may correspond to an OD of a hose.

FIG. 8B shows an embodiment of a gripper insert 861 having either or both of its ends 861 *a, b* configured with a hose alignment or guide rail 837, which facilitate alignment of the carrier assembly (211) on the hose (not viewable here).

Figure 4A:
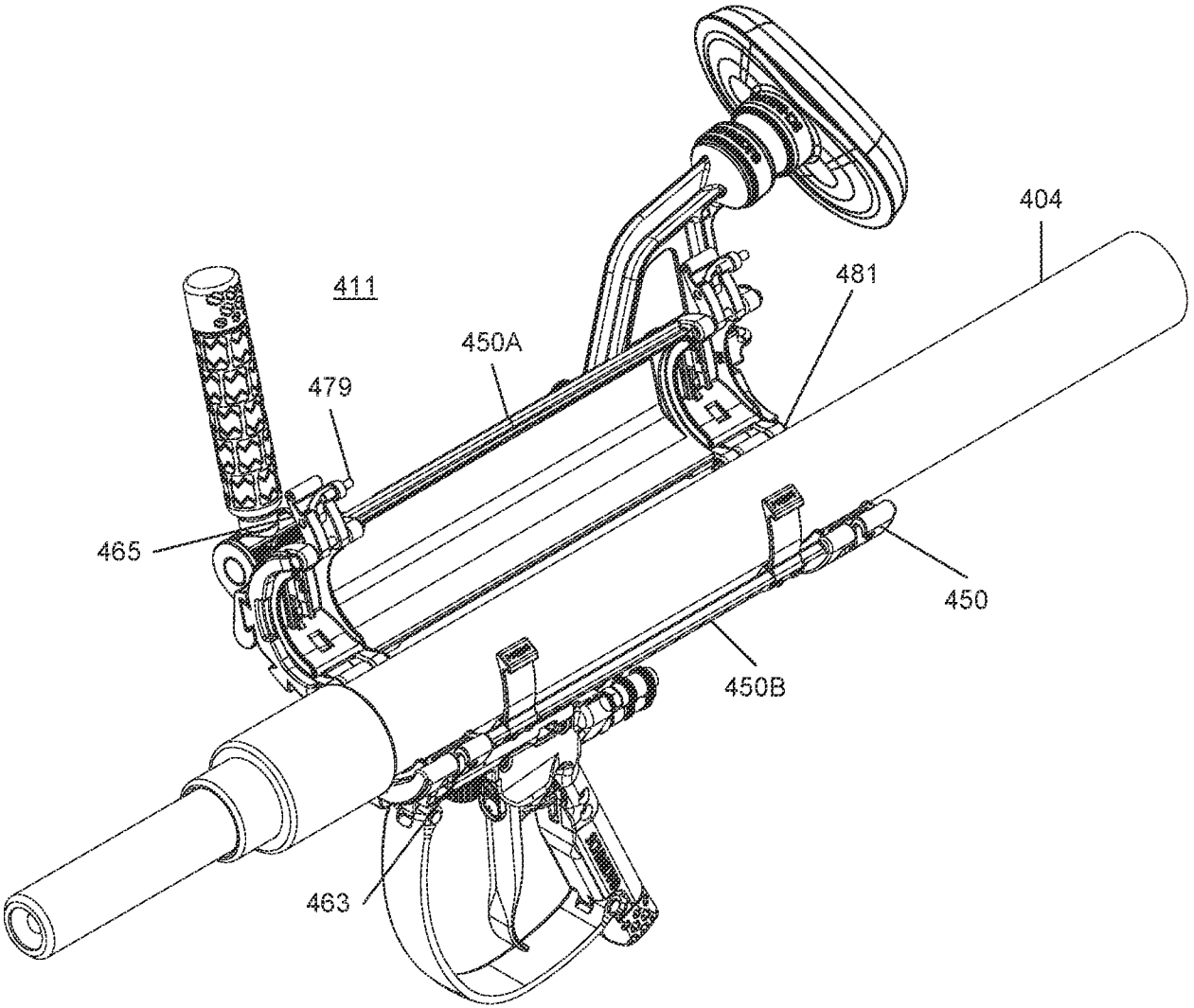
FIG. 4A shows a prospective side view of an open carrier assembly for a blast hose according to embodiments of the disclosure.
Figure 4C:
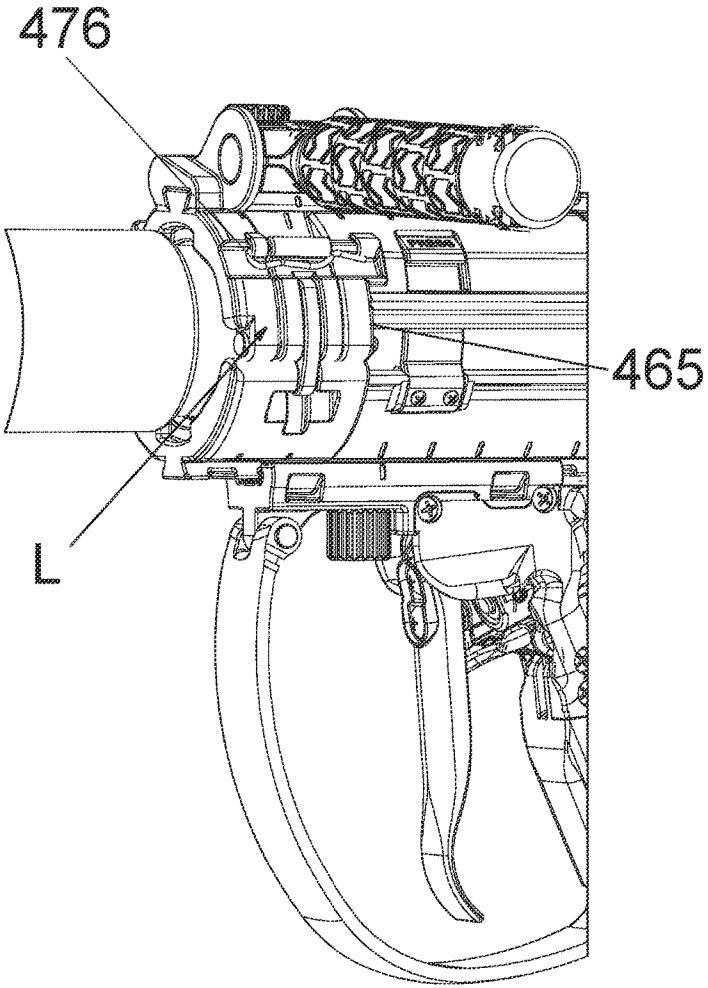
FIG. 4C shows a prospective side view of the carrier assembly closed around the blast hose, and securely latched according to embodiments of the disclosure.
Figure 4B:
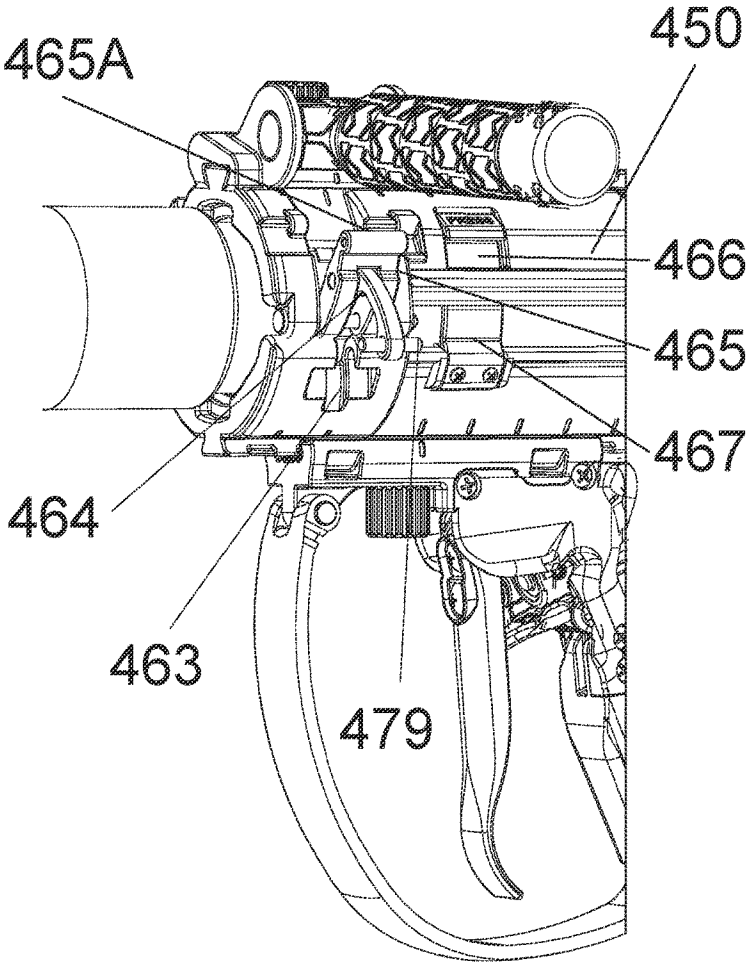
FIG. 4B shows a prospective side view of the carrier assembly closed around (but unlatched) the blast hose according to embodiments of the disclosure.
Figure 4D:
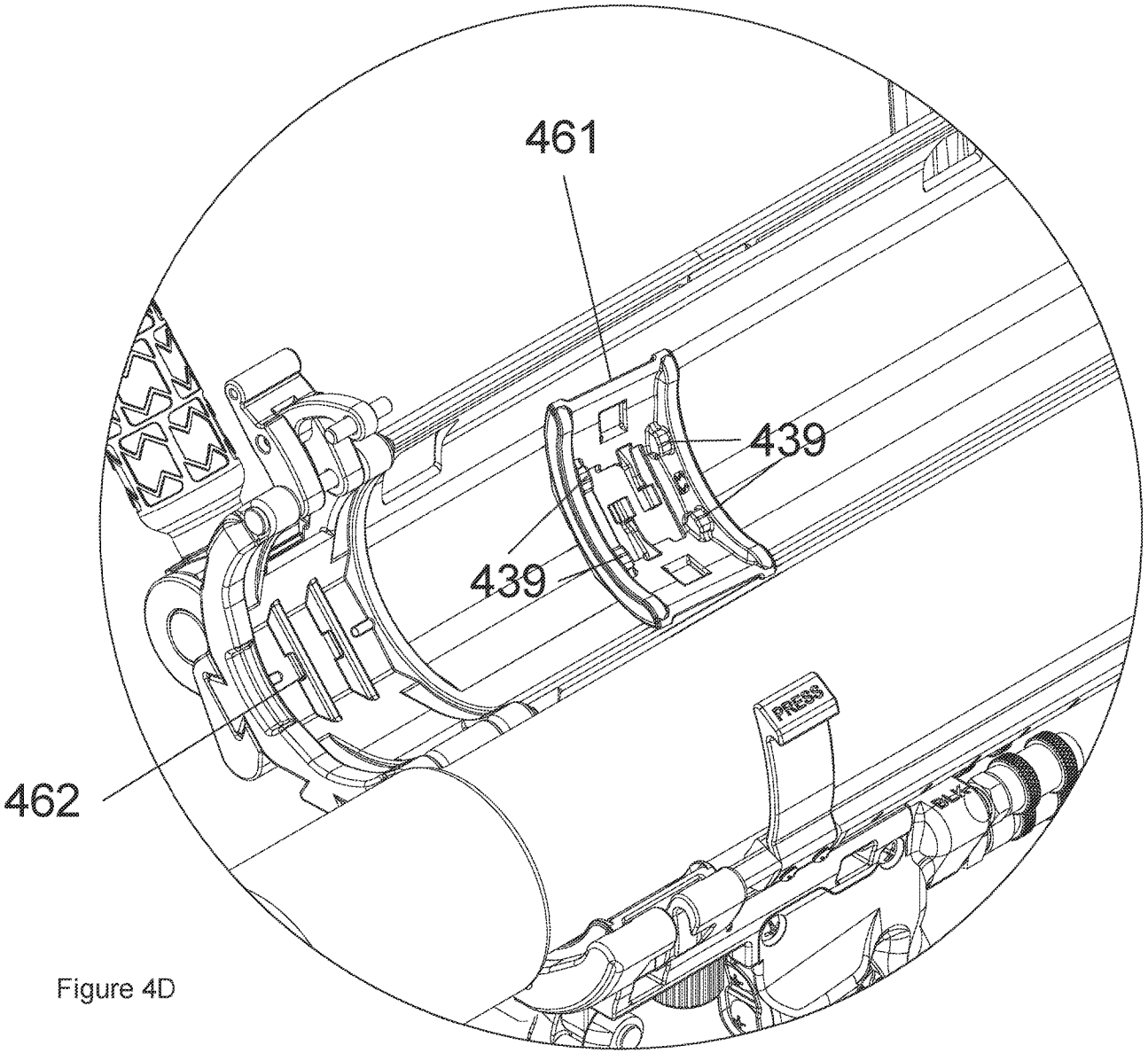
FIG. 4D shows a close-up view of a gripper insert for snap- or press-fit into, and easy removal out of, a gripper receptacle according to embodiments of the disclosure.

FIG. 8C shows an embodiment of a gripper insert 861 configured for simple toolless coupling to the carrier assembly (such as snap-in or press-fit), which could be for install or replacement (see, e.g., FIG. 4D showing insert 461 with at least one wear indicator 439). The gripper insert 861 may have one or more protruding nubs 839. The nubs 839 may be akin to a wear indicator surface, in that the insert 861 may provide the operator with an indication that the hose is starting to wear through. The wear indicator surface 839 may have a top surface depressed a depth (d) from a respective top surface of a proximate rib. The depth (d) may be about 0 inches to about 0.2 inches. There may be one or more wear indicator surfaces 839. As shown here, there may be two surfaces 839 on each side of the insert 861.

FIG. 8D shows an embodiment of a combination gripper insert 861, whereby one side 861*c* has a guide rib 836*a*, and the other side 861*d* having a gripper rib 835. Instead of providing a grip to the hose, the guide rib 836*a* is thicker (with thickness Tg) and provides more surface area for the rib 836*a* to engage the hose. When the gripper insert 861 is engaged against the hose via a latch mechanism (see, e.g., FIGS. 4B/4C latch 465 and latch spring 464), there is a certain amount of force imparted on the hose. The force may be dissipated by adding surface area that results in the guide rib 836*a*.

Returning again to FIGS. 2A and 2B, the carrier assembly 211 may need to withstand substantial forces (such as from abrasive blasting thrust), therefore the assembly 211 may have one or more safety latches 267 configured to releasably couple the first portion 250A and the second portion 250B together. The safety latches 267 may be rigid in nature. The safety latches 267 may be integral to or coupled with the assembly 211, such as via one or more securing members 268. As shown here, the second portion 250B may have two safety latches 267 coupled therewith, and the first portion 250A may have two corresponding safety latch slots 266 configured to securingly mate with respective latches 267. The safety latches may be multi-purpose, such as keeping the portions 250 A/B around the hose if the tension latches fail, keeping the portions 250 A/B aligned, and aid in ease of installation of the assembly 211.

The safety latch 267 may be loose enough to not resist blast hose expansion when pressured, but still coupled sufficiently to keep both portions 250 A/B sufficiently closed to not allow a nozzle holder (FIG. 1B, 105*a*) to longitudinal slide through. The safety latch 267 may provide multipurpose use. For example, the latch 267 may be a backup to other latches (e.g., 265). Also, the latch 267 may ease assembly of the portions 250 A/B onto the blast hose 204.

The assembly 211 may have one or more tension latches 265. Instead of being static or rigid in nature (such as latches 267), the tension latches 265 may have a predetermined amount of tension or elasticity associated therewith via one or more latch springs 264. The latch spring 264 may be configured to accommodate blast hose expansion reducing potential blast hose wear at the barb 259 or gripper 261/hose contact points, and allowing the carrier assembly 211 to continue to rotate on the blast hose. The latch spring 264 may have a spring end configured with a respective latch (dowel) pin 279, which may be configured to fit and mate within a latch T-slot 263. Once the pin 279 resides within the slot 263, the user may further urge the tension latch 265 into a secured position as shown in FIG. 2A. For added security, a safety pin 276 may be disposed within a respective safety pin slot 276A, thereby further holding the tension latch 267 in a secured position. The tension latch 265 may include a latch bracket coupled with the assembly 211 via one or more spring pins 280.

The tension latch 265 may enables the grippers 261 from the portions 250 A/B to maintain sufficient friction on the surface of blast hose OD, which could vary slightly. In addition, the tension latch 265 may be configured to allow expansion of the blast hose (e.g., 104) during operation with minimal increase in grip force.

Figure 2C:
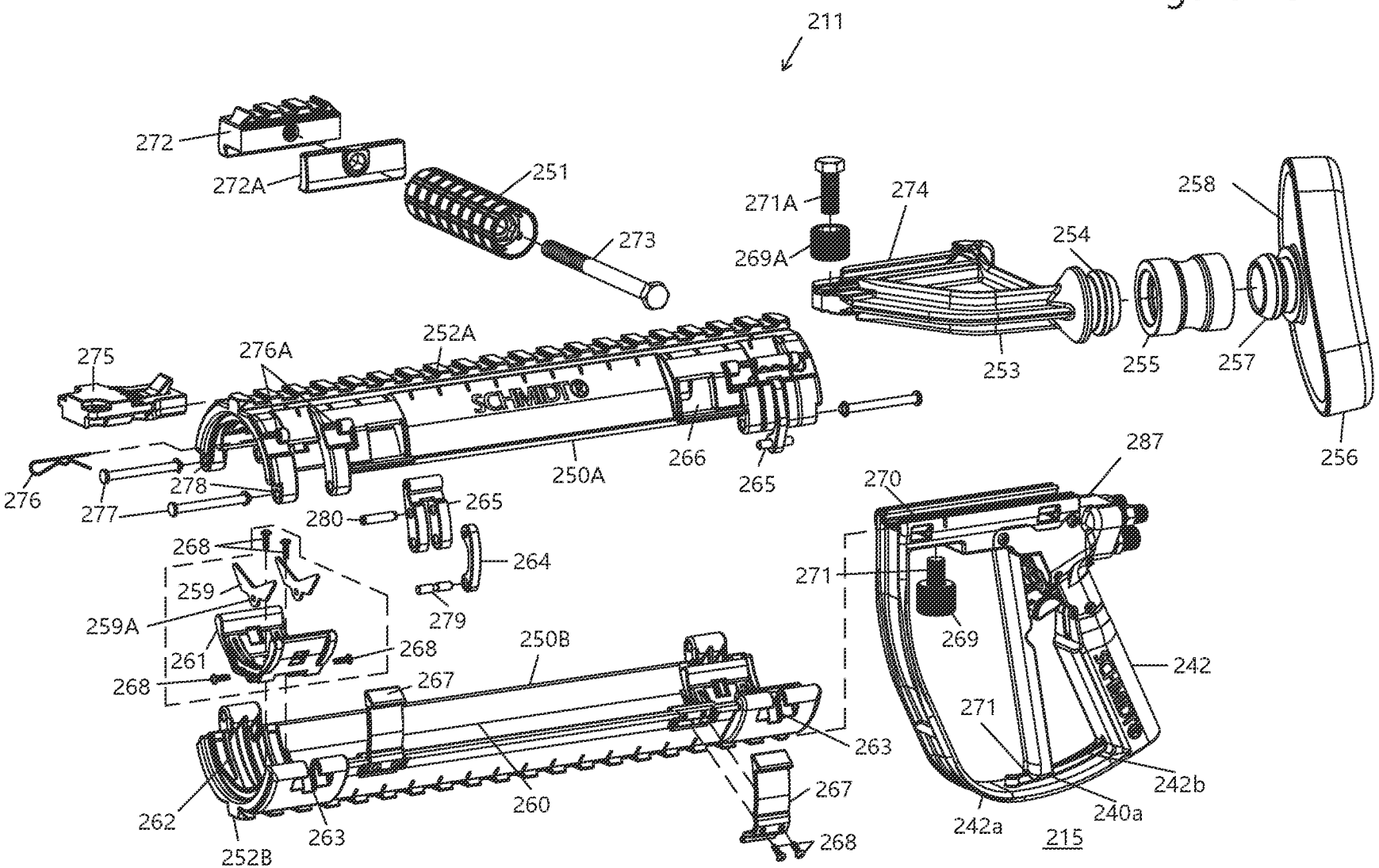
FIG. 2C shows a prospective side component breakout view of an alternative carrier assembly for a hose according to embodiments of the disclosure.

FIG. 2C shows an alternative embodiment of a carrier assembly 211 similar to that of FIGS. 2A-2B, with some notable differences described herein. The carrier assembly 211 may have an elongated body 250 made up of a first portion 250A movingly (such as hingedly) coupled with a second portion 250B. The portions 250 A/B may be coupled together via one or more pins (or comparable) 277 disposed within respective portion slots or holes 278. The assembly 211 may thus have freedom of movement (such as open and close) around assembly rotation point 284.

The assembly 211 may have one or more guide rails 252 A/B. For example, the first portion 250A may have a first guide rail 252A and/or the second portion 250B may have a respective guide rail 252B. The guide rails 252 A/B may be an elongated slot-type structure disposed or otherwise formed along an outer assembly surface 285 for the length of the portions.

A secondary handle mount 272 may be coupled with the first rail 252A. There may be a secondary handle 251 integral to or coupled with the handle mount 272. As shown here, the secondary handle 251 may be coupled with a mount sidewall 272 via a handle coupler 273.

There may be a pad mount 253 coupled with the first rail 252A. For example, the pad mount 253 may have a rail slot 274 (on either or both sides of the mount 253) configured to movingly (slidingly) engage the first rail 252A. Accordingly, the position of the pad mount 253 may be adjustable along the rail 252A, and the orientation of the pad mount 253 may be extended outwardly left or right.

The pad mount 253 may be releasably coupled with the first rail 252A in any suitable manner, such as via a twistable knob 269A having a lock screw 271A disposed therethrough (the lock screw 271A engageable against the rail 252A via a hole in the mount 253).

The pad mount 253 may have a pad 256 integral to or coupled therewith. The pad mount 253 may have a coupler extension 254, which may provide the ability to couple any number of pad configurations (shapes, sizes, materials, etc.) to the assembly 211. The pad 256 may be pliable or deformable type material such as foam or rubber, and may be coupled (such as adhesively) to a pad backing 258. The pad backing 258 may have a pad extension 257. The coupler extension 254 and the pad extension 257 may couple together directly, or in other embodiments indirectly, such as via a coupler or nipple 255.

As may be desired, there may be any number of other mounts coupled with the body 250, such as auxiliary mount 275. The auxiliary mount 275 may be configured for equipment such as a light or camera to be coupled with the assembly 211. Any such mount may attach the to the rails 252 A/B, such as by sliding, snapping, fastening, etc.

The carrier assembly 211 may have a deadman assembly 215 coupled therewith. Although not meant to be limited, the deadman assembly 215 may have a trigger 240/handle (or body) 242 configuration that may provide a user the ability to hold the deadman 215 on an axis offset from that of the blast hose.

In order to provide stability to the trigger 240, a lower portion 242*a* of the frame 242 may be configured with a stabilization or guide ridge 242*b*. The stabilization ridge 242*b* may be configured to engage or interact with a trigger rail 271. The trigger rail 271 may be formed or otherwise disposed in a bottom trigger portion 240*a* of the trigger 240.

The deadman assembly 215 may have an upper end 287 configured with a deadman rail slot 270, which may accommodate moving (sliding) engagement onto the second guide rail 252B. The deadman 215 may be releasably coupled with the second rail 252B in any suitable manner, such as via a twistable knob 269 having a lock screw 271 disposed therethrough. Although not shown here, the deadman assembly 215 may operably coupled with peripheral equipment, such as a power source or control logic, via connection point 282.

The inside or underside 260 of the carrier assembly 211 may engage with the hose. To provide added support and grip, there may be one or more gripper inserts or barb adapters 261 disposed within an adapter receptacle 262 of either or both of the portions 250 A/B. The inserts 261 may be secured within the receptable 262 via snapping, press-fit, securing members 268, combinations thereof, or other suitable coupling.

One or more barbs 259 may be disposed within the respective gripper insert 261. The barbs 259 may be integral, or coupled therewith (such as via one or more securing members 268 [pins, screws, etc.] disposed through any respective barb eyelet 259A). The barbs 259 may be configured to engage the hose in a sufficient manner to prevent any significant longitudinal movement of the hose while disposed within the assembly 211. Just the same, the barbs 259 need not prevent (some) rotation of the hose, and thus may provide a measured freedom of movement. As the barb 259 may be removable, other sizes may be used in order to accommodate different sizes of hose.

The barbs 259 may be, but need not be, the same for all hose sizes. The gripper inserts 261 may be sized for different hose sizes. In aspects, the barbs on the insert 261 may keep a (blast) hose straight in the carrier assembly 211. The presence of modular barbs 259 and combined with tension latches 265 may be useful to accommodate hose expansion, as well as allow the carrier assembly 211 to rotate (but not slide) on the hose 204.

It is worth noting that the insert 261 may be integral with the respective portion 250 A/B, and thus while referred to as 'gripper insert' could simply just be referred to as a gripper feature. Moreover, instead of a barb 259, the insert 261 may be a unitary piece configured with one or more ribs or other features. Thus, the receptacle 262, insert 261, and barb 259 may all be integrated together as a part of the portion 250 A/B.

The assembly 211 may have one or more safety latches 267 configured to releasably couple the first portion 250A and the second portion 250B together. The safety latches 267 may be rigid in nature. The safety latches 267 may be integral to or coupled with the assembly 211, such as via one or more securing members 268. As shown here, the second portion 250B may have two safety latches 267 coupled therewith, and the first portion 250A may have two corresponding safety latch slots 266 configured to securingly mate with respective latches 267. The safety latches may be multi-purpose, such as keeping the portions 250 A/B around the hose if the tension latches fail, keeping the portions 250 A/B aligned, and aid in ease of installation of the assembly 211.

The safety latch 267 may be loose enough to not resist blast hose expansion when pressured, but still coupled sufficiently to keep both portions 250 A/B sufficiently closed to not allow a nozzle holder (FIG. 1B, 105A) to longitudinal slide through. The safety latch 267 may provide multipurpose use. For example, the latch 267 may be a backup to other latches (e.g., 265). Also, the latch 267 may ease assembly of the portions 250 A/B onto the blast hose 204.

The assembly 211 may have one or more tension latches 265. Instead of being static or rigid in nature (such as latches 267), the tension latches 265 may have a predetermined amount of tension or elasticity associated therewith via one or more latch springs 264. The latch spring 264 may be configured to accommodate blast hose expansion reducing potential blast hose wear at the barb 259/hose contact points, and allowing the carrier assembly 211 to continue to rotate on the blast hose. The latch spring 264 may have a spring end configured with a respective latch (dowel) pin 279, which may be configured to fit and mate within a latch T-slot 263. Once the pin 279 resides within the slot 263, the user may further urge the tension latch 265 into a secured position as shown in FIG. 2A. For added security, a safety pin 276 may be disposed within a respective safety pin slot 276A, thereby further holding the tension latch 267 in a secured position. The tension latch 265 may include a latch bracket coupled with the assembly 211 via one or more spring pins 280.

The tension latch 265 may enables the grippers from the portions 250 A/B to maintain sufficient friction on the surface of blast hose OD, which could vary slightly. In addition, the tension latch 265 may be configured to allow expansion of the blast hose (during operation) 204 with minimal increase in grip force.

Referring now to FIGS. 3A, 3B, 3C, and 3D together, a process diagram view of an abrasive blasting system in a blast mode, a close-up side cross-sectional view of a deadman assembly in a no-blast mode, a deadman assembly in a no-blast, nozzle-vent mode (or sometimes non-emergency), and a deadman assembly in the blast mode, respectively, illustrative of embodiments disclosed herein, are shown.

FIGS. 3A-3D illustrate an abrasive blasting system 300 for use in treating a surface 308. As shown here, the blasting system 300 may include a multi-position, multi-function deadman assembly 315. That is, the deadman assembly 315 may be operable in more than a blast/no-blast configuration.

The deadman assembly 315 may be part of or coupled with a carrier assembly 311. While it need not be exactly the same, the carrier assembly 311 may be like that of assembly 111, 211, etc., and components thereof may be duplicate or analogous. Thus, only a brief discussion of the assembly 311 may be provided, recognizing that differences, if any, would be discernable by one of skill in the art, especially in view of the present disclosure.

Figure 3A:
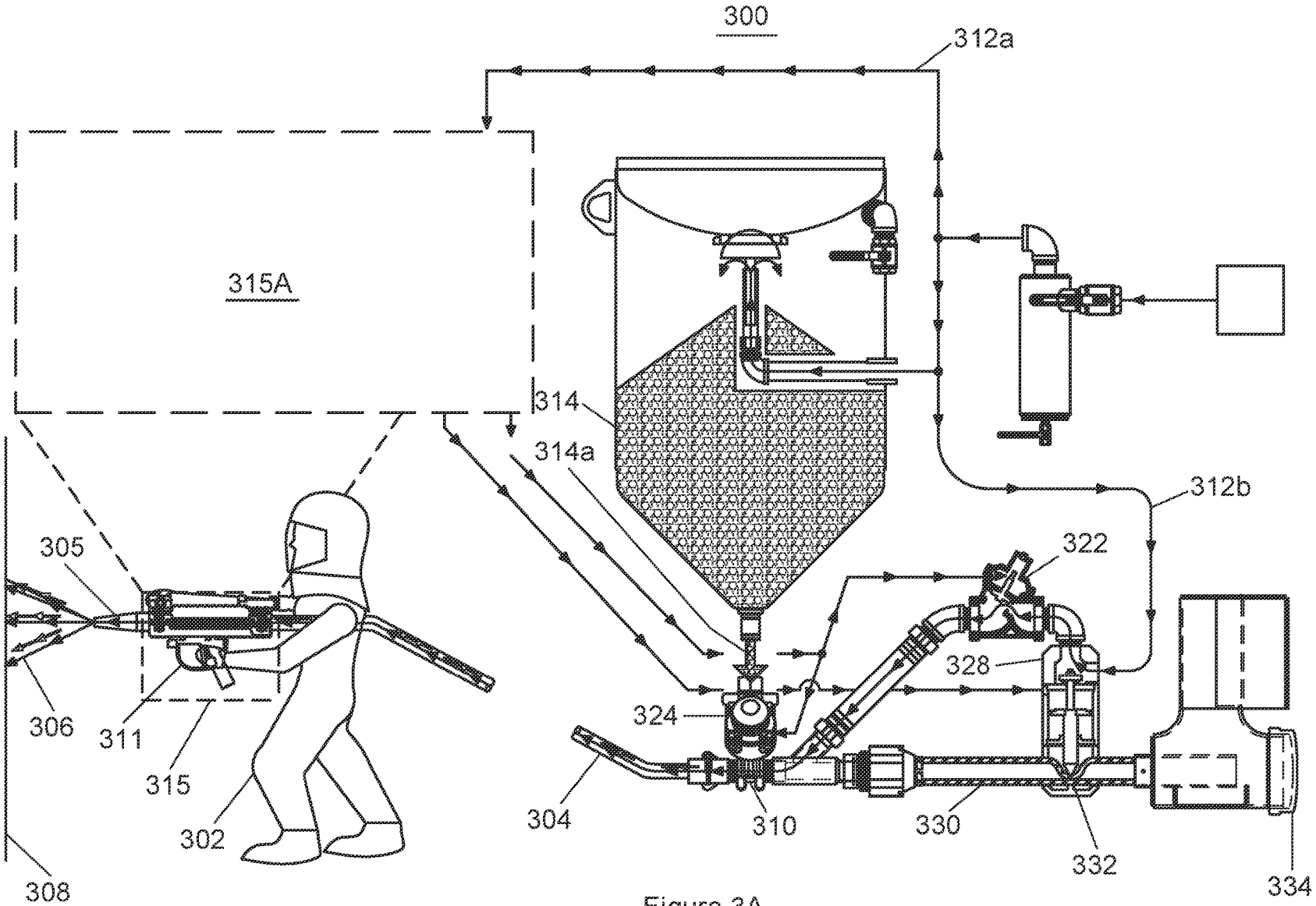
FIG. 3A shows a process diagram view of an abrasive blasting system in a blast mode according to embodiments of the disclosure.
Figure 3D:
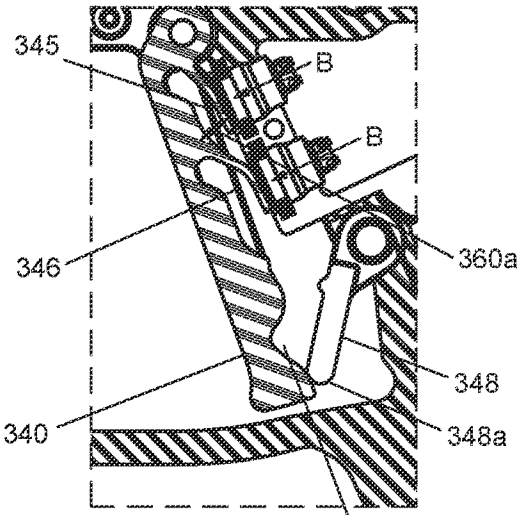
FIG. 3D shows a close-up side cross-sectional view of a deadman assembly in a blast mode according to embodiments of the disclosure.
Figure 3C:
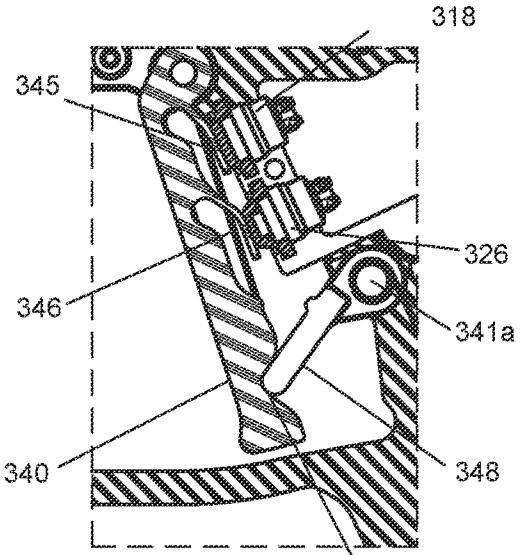
FIG. 3C shows a close-up side cross-sectional view of a deadman assembly in a no-blast, nozzle-vent mode (or sometimes non-emergency) according to embodiments of the disclosure.
Figure 3B:
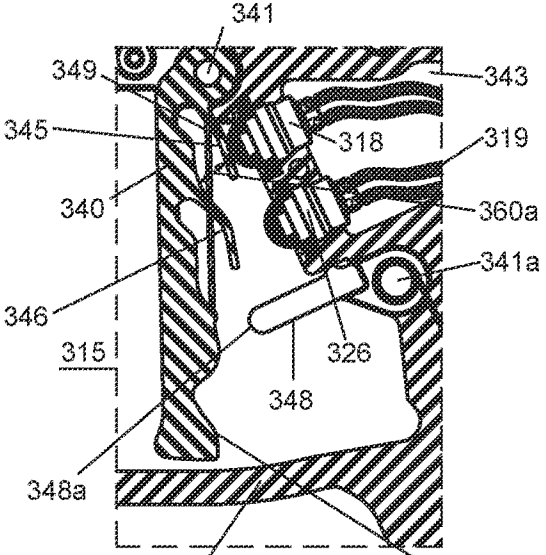
FIG. 3B shows a close-up side cross-sectional view of a deadman assembly in a no-blast mode according to embodiments of the disclosure.

The deadman assembly 315 may be associated with system operation logic 315A, the configuration and operation of which may depend on the position of the trigger lever 340, as illustrated in FIGS. 3B-3D. To show the ease of interchangeability of the deadman 315, FIG. 3B illustrates an electrical-type deadman, whereas FIGS. 3C-D show pneumatic, Any component of the system 300 may be in operable communication with a power source (not viewable here). Embodiments herein are not meant to be limited, and varied power configurations for the deadman assembly 315 (and system 300) may be possible, such as electrical, pneumatic, hydraulic, and so forth.

By way of the carrier assembly 311, the deadman 315 may be suited for applications that permit a blast nozzle 305 (or an area proximate thereto) to be held indirectly by an operator 302 facing forward during operation. In the blast mode shown in FIG. 3A (corresponding to trigger position of FIG. 3D), this mode may entail the operator 302 fully engaging the deadman assembly 315 in a manner whereby the system logic 315A may activate one or more controllers such that signal airflow 312*a* may now transfer to the air valve 322 and the metering valve 324. Once the air valve 322 opens, blast air 312*b* may flow through the valve 322 toward mixer 310. In a similar manner, once the media valve 324 opens, media 314*a* may transfer from media storage 314, through the valve 324, and into mixer 310.

As the vent line 330 remains closed (pinched) [via logic 315A], the only path for the mixed air and media 306 is through hose 304 and out of the nozzle 305. The blast media 306 impacts against the surface 308 to accomplish the desired blasting outcome. Instead of the cumbersome mode of spraying with a conventional hose and deadman, the operator 302 may readily hold the carrier assembly 311 in accordance with embodiments herein.

Briefly, FIG. 3B illustrates the lever 340 in an unengaged (or unsqueezed, etc.) or released position which may result in a no-flow configuration for logic 315A. For example, a control signal may be withheld or otherwise disabled in a manner that the signal does not communicate from the logic 315A, and as such prevents an airflow signal 312*a* from transferring from airflow source 312 to respective downstream valves.

In this respect, the logic 315A may prevent airflow 312*a* from transferring to combination valve 328. 'Combination valve' in this sense means the valve 328 may have a combined dual function associated with it, such as controlling blast air 312*b*, while at the same time pinching/unpinching the exhaust line 330 in an area proximate to a pinch point 332. In embodiments, a ram may be in a normally open position when airflow 312*a* is withheld from the valve 328. At the same time, the valve end may be closed, therefore preventing blast air 312*b* to flow to the air valve 322.

In a similar vein the blast air valve 322 and the metering valve 324 may be in a normally closed position, whereby blast air 312*b* and (dry) media 314*a* are prevented from entering mixing zone or region 310.

In the event the deadman assembly 315 was previously engaged, but then released, there may be residual flow within the blast line 304. However, as the exhaust line 330 may become unpinched (not shown here), residual flow may exit an outlet of a muffler 334.

The trigger 340 may be movingly (such as pivotably) coupled with the frame 342, such as at pivot point 341. The trigger 340 may be biased away from engaging the switches (or valves or other suitable control devices within the deadman 315) 318, 326, such that an amount of squeezing force may be needed in order to move the trigger 340.

Any initial attempt to squeeze the trigger 340 may be impeded by coming into contact with an end 348*a* of a lock flap 348. The lock flap 348 may be movingly (such as pivotably) coupled with the frame 342, such as at pivot point 341*a*. The lock flap 348 may have a first position. The first position of the lock flap 348 may prevent the trigger (or respective cantilever tabs 345, 346) from engaging (closing) the switches 318, 326. The lock flap 348 may be biased (such as with a spring) to the first position.

Either or both of the switches may be protected via a sheathing 349. The switches 318, 326 may be operably associated with the logic circuit 315A (and respective controllers via wiring, lines, infrared, or other suitable signal transmission configuration). As shown here, wiring 319 may be disposed within a cavity 343. The cavity 343 may be enclosed in order to prevent or mitigate against the presence of debris, particulate, etc.

FIG. 3C illustrates the deadman 315 moved to a no-blast, nozzle-vent mode (or sometimes non-emergency), which may entail the operator 302 partially releasing the deadman assembly 315 such that the trigger/lever 340 may energize the primary switch 318, but is prohibited from doing the same for the secondary switch 326.

As the logic 315A may be (partially) open, airflow 312*a* may be transferred to the combo valve 328 in sufficient enough manner to move (urge) the ram against the exhaust line 330 at pinch point 332, thereby 'closing' off the line 330 (or keeping it closed).

In normal operation, the operator 302 may be engaged in blast mode (FIG. 3A), but then desires a non-emergency release, whereby the line 330 stays closed, and any remnant air and media thus released out of the nozzle 305. As such, FIG. 3C may generally represent the shift from the blast mode to a non-emergency (partial) release of the deadman assembly 315.

Only when the operator 302 manually toggles a lock flap 348 out of the way of the handle 340 will the operator 302 be able to fully squeeze the handle 340 in order to engage/close switch 326 (and thus move back to blast mode—FIGS. 3A and 3D). Otherwise, as shown here in FIG. 3C, the lock flap 348 may be configured to prohibit the movement of the handle 340 in order to engage the secondary switch 326 (but yet able to engage the primary switch 318). The lock flap 348 may have an intermediate or second position of FIG. 3C that allows the trigger to engage primary switch 318, but not engage the secondary switch 326.

For example, an end 348*a* of the lock flap 348, by being moved into recess 347, may be engaged with and prevent movement of the handle 340 from the position shown in FIG. 3C in order to initiate the blast mode (3D). The only way to initiate blast mode is to (manually) move the lock flap 348 out of the way (via pivot connection point 341*a*), which means further moving the end 348*a* out of the recess 347. But unless and until this action occurs, or the handle 340 is released, the deadman assembly 315 may remain in the no-blast, nozzle-vent mode.

FIG. 3D corresponds to the blast mode shown in FIG. 3A, which entails the operator 302 fully engaging the deadman assembly 315 in a manner whereby the trigger/lever 340 may energize each of the primary switch 318 and the secondary switch 326, as indicated by depressed switch arrows B. This may only occur then the operator 302 manually moves an end 348*a* of lock flap 348 out of the way (whereby the end 348*a* may be moved further out of or beyond recess 347). When the switches 318 and 336 are engaged, the system 300 may be in the blast mode of FIG. 3A.

Figure 6C:
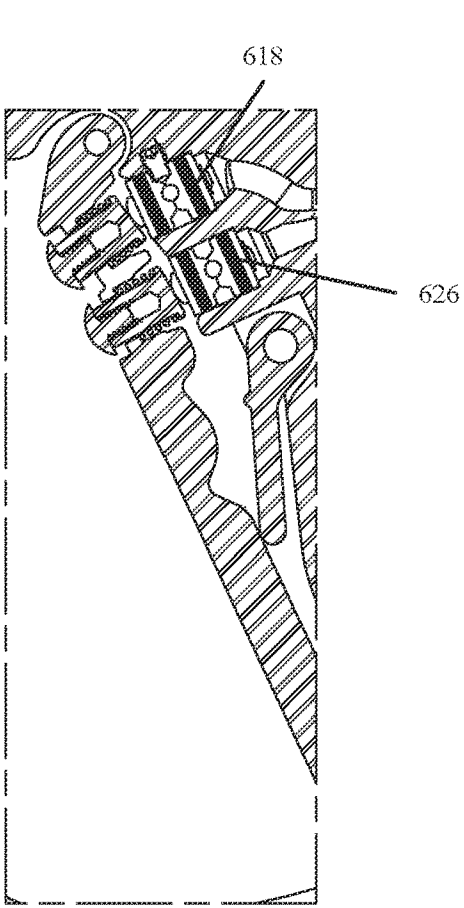
FIG. 6C shows a close-up side cross-sectional view of the deadman assembly of FIG. 6A in a blast mode according to embodiments of the disclosure.
Figure 6B:
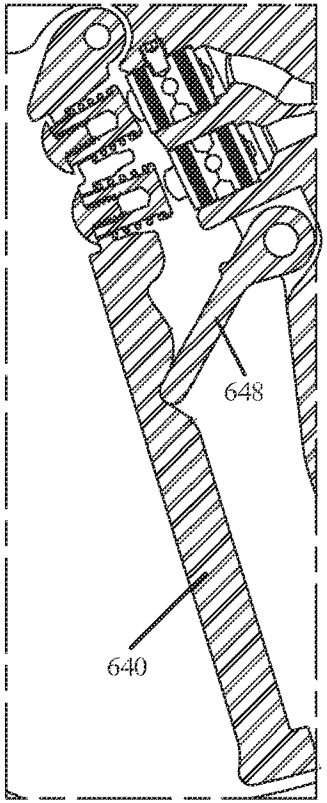
FIG. 6B shows a close-up side cross-sectional view of the deadman assembly of FIG. 6A in a no-blast, nozzle-vent mode (or sometimes non-emergency) according to embodiments of the disclosure.
Figure 6A:
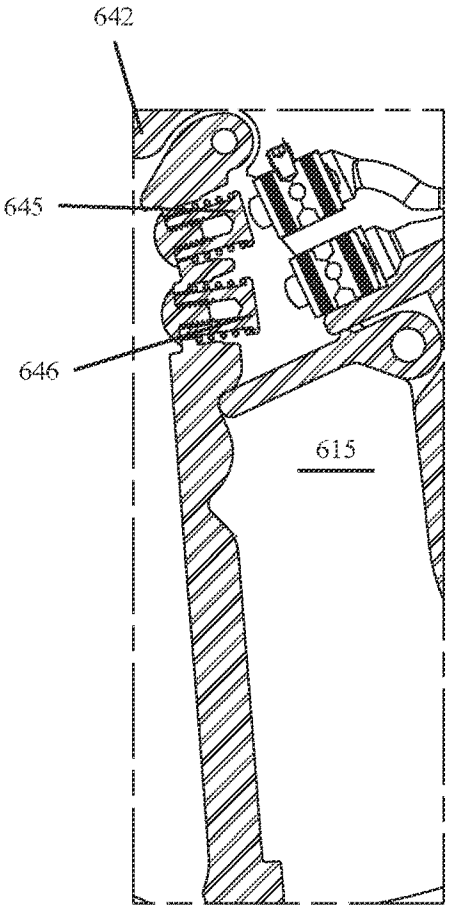
FIG. 6A shows a close-up side cross-sectional view of a plunger-activated pneumatic deadman assembly in a no-blast mode according to embodiments of the disclosure.

Referring briefly to FIGS. 6A, 6B, and 6C together, a close-up side cross-sectional view of a pneumatic deadman assembly in a no-blast or emergency shutdown mode having a biased trigger mechanism, a close-up side cross-sectional view of the deadman assembly moved to a no-blast, nozzle-vent mode, and a close-up side cross-sectional view of the deadman assembly moved to a blast mode, respectively, illustrative of embodiments disclosed herein, are shown.

FIGS. 6A-6C illustrate a deadman assembly 615 for use with an abrasive blasting system (such as any system described herein) that may be multi-position, multi-function (akin to 315, etc.).

One of skill would readily appreciate similarities of the deadman assembly 615 to other embodiments described herein, and for the sake of brevity, only a brief description is provided. As seen, the deadman assembly may utilize a primary pneumatic valve 618 and a second pneumatic valve 626. In order to actuate either or both of the valves 618, 626, a respective plunger 645 and 646 must be moved into contact therewith.

A trigger 640 may be movingly (such as pivotably) coupled with the frame 642. The trigger 640 may be biased away from engaging the valves 618, 626, such that an amount of squeezing force may be needed in order to move the trigger 640.

Any initial attempt to squeeze the trigger 640 may be impeded by coming into contact with a lock flap 648. The lock flap 648 may be movingly (such as pivotably) coupled with the frame 642. The lock flap 648 may have a first position (FIG. 6A), a second position (FIG. 6B), and a third position (FIG. 6C), each corresponding a mode of operation.

Referring now to FIGS. 4A, 4B, 4C, and 4D together, a prospective side view of an open carrier assembly for a blast hose, a prospective side view of the carrier assembly closed around (safety latches engaged but not fully latched) the blast hose, a prospective side view of the carrier assembly closed around the blast hose, and securely latched, and a close-up view of a gripper insert for snap- or press-fit into, and easy removal out of, a gripper receptacle respectively, illustrative of embodiments disclosed herein, are shown.

While it need not be exactly the same, the carrier assembly 411 may be like that of assembly 111, 211, etc., and components thereof may be duplicate or analogous. Thus, only a brief discussion of the assembly 411 may be provided, recognizing that differences, if any, would be discernable by one of skill in the art, especially in view of the present disclosure.

To use the assembly 411 with a hose 404, a user may separate or open first and second portions 450 A/B whereby the hose 404 may reside or be disposed therein, as shown in FIG. 4A. The portions 450 A/B may then be closed together (such as rotating via hinges 481).

FIG. 4B shows the unlatched (with safety latches 467 engaged) view of the assembly 411, where the tension latch 465 has its upper latch end 465A extended outward from the carrier body 450. This allows a latch pin 479 on the end of latch spring 464 enough clearance to move below and into a latch T-slot 463. The safety latch 467 in the second portion 450B may be engaged in the safety latch slot 466 in first portion 450A holding carrier assembly 411 in place on the blast hose (see the gap between the safety latch 467 and the upper body 450A in FIG. 4C when the tension latches are engaged).

FIG. 4C shows when the latch pin 479 is within the slot 463, the user may push the tension latch end 465 against the body 450, which results in the pin 479 pulling the second portion 450B tighter against the first portion 450A, and the tension latch 465 moved to a latched position L. A safety pin 476 may be inserted within the latch 465 providing an added measure of safety in keeping the assembly 411 around the hose 404.

FIG. 4D shows there may be an insert 861, which may mate into an insert receptacle 462. Each of the portions 450A, 450B may have a respective insert 461. The insert 461 may be configured for simple toolless coupling to the carrier assembly (such as snap-in or press-fit), which could be for install or replacement. There may be a finger or dog of the insert 461 configured to mate with a feature of the receptacle 462.

The gripper insert 461 may have one or more protruding nubs 439. The nubs 439 may be akin to a wear indicator surface, in that the insert 461 may provide the operator with an indication that the hose is starting to wear through (and needs to be replaced). The wear indicator surface 439 may have a top surface depressed a depth (d) from a respective top surface of a proximate rib. The depth (d) may be about 0 inches to about 0.2 inches. There may be one or more wear indicator surfaces 439. As shown here, there may be two surfaces 439 on each side of the insert 461.

Figure 7B:
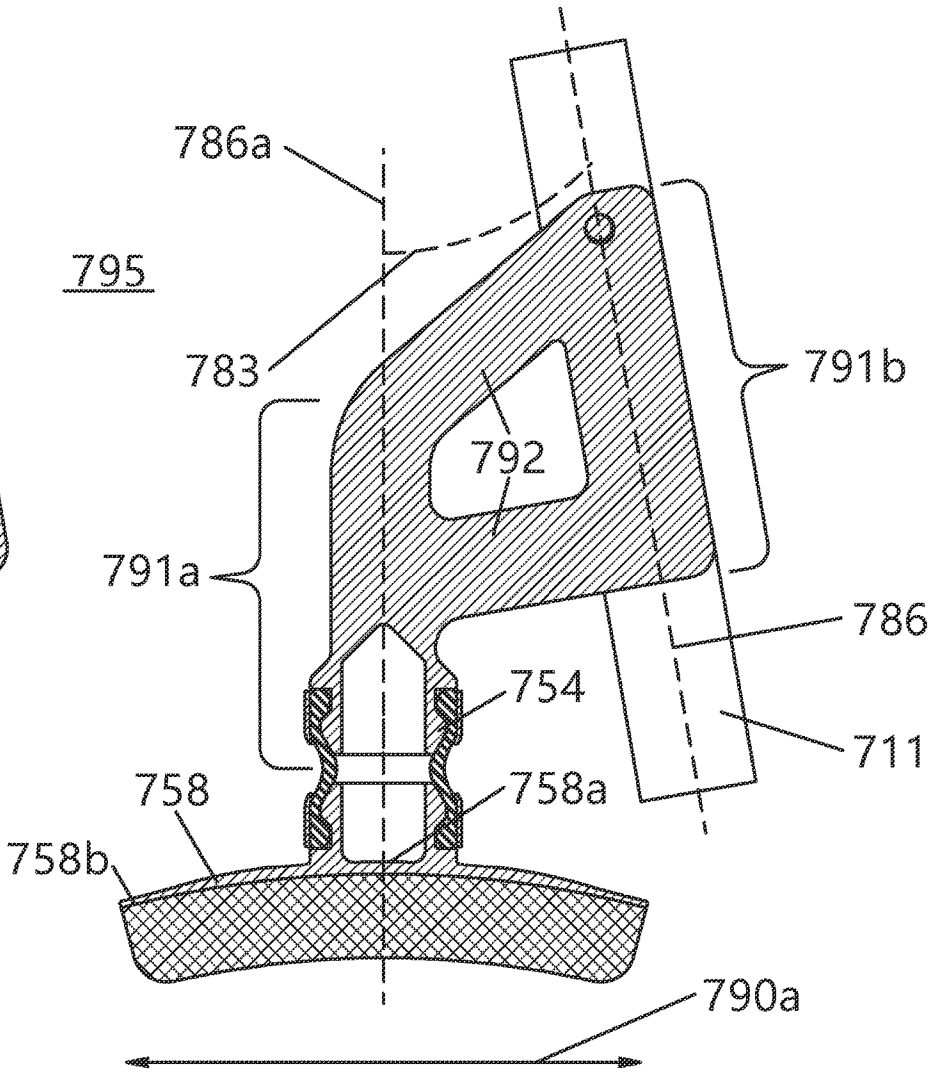
FIG. 7B shows a lateral cross-sectional view of the thrust management system of FIG. 7A coupled with a brace assembly and having a rotated pad according to embodiments of the disclosure.
Figure 7A:
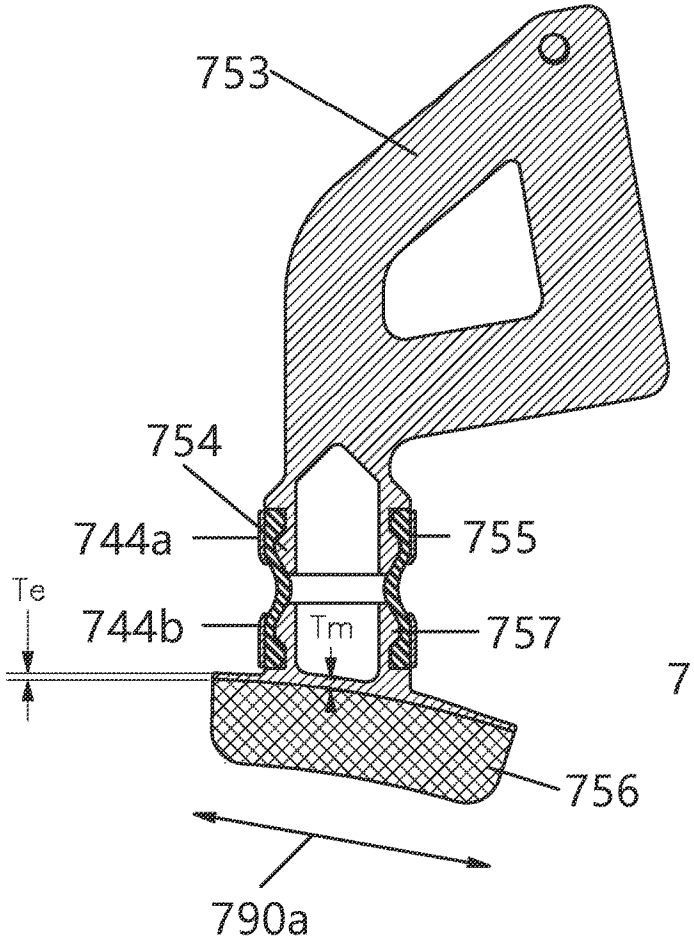
FIG. 7A shows a lateral cross-sectional view of a thrust management system according to embodiments of the disclosure.

Referring now to FIGS. 7A and 7B together, a lateral cross-sectional view of a thrust management system, and a lateral cross-sectional view of the thrust management system coupled with a carrier assembly and having a rotated pad respectively, illustrative of embodiments disclosed herein, are shown.

While it need not be exactly the same, a thrust management system 795 shown in FIGS. 7A-7B together may be like that of embodiments herein, etc., and components thereof may be duplicate or analogous. Thus, only a brief discussion of the system may be provided, recognizing that differences, if any, would be discernable by one of skill in the art, especially in view of the present disclosure.

The thrust management system 795 may include a pad mount 753, a coupler 755, a pad mount backing 758, and a pad 756. The pad mount 753 may be coupled with a hose or the like via a carrier assembly 711. The thrust management system 795 may include the pad mount 753 configured to couple to the carrier assembly 711 (e.g., FIG. 1B). The pad mount 753 may be coupled with the pad mount backing 758 via the coupler 755. The pad mount backing 758 and the pad mount 753 may be hard or rigid in nature. Just the same, the pad mount backing 758 need not be limited, and may thus have some amount of flexibility. The coupler 755 and the pad 756 may be soft or pliable in nature.

The pad mount 753 may have one or more elongated sections (portions, members, etc.), such as a first elongated member 791*b*. The first elongated member 791*b* may be configured in a manner to accommodate mounting with the carrier assembly 711, such as being slotted or grooved (to mate with a respective rail of the assembly). The pad mount 753 may have a second elongated member 791*a*. The second elongated member 791*a* may be integral to the first elongated member 791*b*, but need not be.

As shown here, the second elongated member 791*a* may be integral to or otherwise coupled with the first elongated member 791*b* via one or more support members 792. The second elongated member 791*a* may have an end that terminates into a pad coupler extension 754. The pad coupler extension may be coupled into or with the coupler 755, similar to the pad mount backing 758 having a pad mount extension 757 that may also couple into or with the coupler 755.

The pad mount backing 758 may be a rigid, semi-rigid, or semi-flexible piece having the conformable pad 756 disposed thereon. The pad 756 may be glued, adhered, press fit, or the like, with the pad mount backing 758. The pad mount backing 758 and the pad 756 may be operable together to provide comfortability to an operator during an operation, while at the same time be durable enough to provide thrust displacement and distribution onto the user.

To facilitate this ability, the pad mount backing 758 may have a specific thickness profile. The pad mount backing 758 may have a middle pad mount backing section 758*a*, as well as an end pad mount backing section 758*b*. As viewable in cross-section here, the middle pad mount backing section 758*a* may be thicker than the end pad mount backing section 758*b*. Thus, the middle pad mount backing section 758*a* may have a middle thickness Tm that is greater than an end thickness Te. A ratio of thickness Tm:Te may be in the range of about 0.5 to about 4. In embodiments, the ratio may be in the range of about 1.5 to about 2.5. In other embodiments, the ratio may be in the range of about 1.2 to about 4. For example, the middle thickness Tm may be about 0.15", and the end thickness Te may be about 0.075".

The thickness profile ratio may be generally consistent in the pad mount backing 758, regardless of shape or size of the mount (or pad). For example, FIG. 7A shows the pad 756 and pad mount backing 758 in first configuration, whereas FIG. 7B shows the pad/pad mount backing rotated. Be that as it may, along a same reference 790*a*, the profile ratio of Tm:Te may be the same regardless.

The varied thickness profile of the pad mount backing 758 may be useful to allow the backing 758 to be rigid in the center portion 758*a*, which may facilitate distribution of thrust out in a larger section of the pad 756, while yet being flexible at the edge(s) 758*b* to prevent the backing 758 (or pad 756) from "digging" into the body (196) when a blast nozzle (105) is angled from perpendicular to the body. The combination of the pad 756, pad mount backing 758, and coupler 755 may allow the pad 756 to remain contoured to the body (196) and in a comfortable position regardless of nozzle position.

FIGS. 7A and 7B illustrate the first elongated member 791*b* may have a central or reference axis 786 that may be aligned with or parallel to an axis of the carrier assembly 711. The second elongated member 791*a* may have a respective central axis 786*a*. In an embodiment, the central axis 786 and the respective central axis 786*a* may be offset or unaligned, such as by an offset angle 783. In embodiments, the offset angle 783 may be in the range of about −20 degrees to about 45 degrees. For example, the offset angle 783 may be in an offset range of about 5 degrees to about 15 degrees. As another example, the range may be about 9 degrees to about 11 degrees.

Embodiments herein may provide for methods of use and operation of one or more systems disclosed herein, comparable variants, and/or components thereof. Methods herein may refer to use and/or operation of an abrasive blasting operation that may utilize a multi-position, multi-configuration deadman assembly. While referred to as pneumatic, other control mechanisms are possible, such as electrical.

The method may include providing or arranging for one or more abrasive blasting components, such as a hose, blast pot, control valves, a deadman assembly, and so forth. The method may include use and/or operation of associated or auxiliary equipment including automation, controllers, piping, hosing, valves, wiring, nozzles, pumps, gearing, tanks, etc. may be shown only in part, or may not be shown or described, as one of skill in the art would have an understanding of coupling the components for operation thereof. All components of the method requiring power or automation may be provided with wiring, tubing, piping, etc. in order to be operable therefore.

The method may include use and/or operation of a deadman assembly that may be associated with a pneumatic flow control or comparable. The method may include operating the deadman assembly in a blast mode or a no-blast mode. There may be a no-blast, nozzle vent mode.

The method may include configuring the deadman assembly with one or more pneumatic trigger deadman cartridges operable to send or transfer air from the reduced pressure air supply coming from regulator to respective pneumatic control valves.

The method may include coupling respective hosing to fittings associated with the deadman assembly, air source, regulator, control valves, and any other downstream equipment. The air pressure regulator may be set to reduce the air pressure to the deadman assembly.

The method may include operating or moving a trigger of a deadman assembly to the blast mode. As such, the deadman assembly valves may allow the compressed air to now flow into the signal port and then to the pilot port of the respective control valves. This pressure may be determined by the regulator. So for example, the pressure in the line between the deadman and the control valves may be a reduced, regulated pressure of about 70 psig (as compared to the air source, which may be in excess of 120 psig).

The method may include releasing the deadman assembly to shut off, whereby the deadman supply port is shut off and the deadman signal or pilot port may be vented to atmospheric through the remote deadman valves until the pressure drops below the control valve deactivation pressure at the pilot port. The control valve(s) may then shut off air pressure and vent the signal line of the abrasive, air, and exhaust valve to atmospheric through vents.

The method may include a deactivation response time of about one to two seconds or less by reducing this pressure differential. In embodiments the pressure differential between the deadman assembly and the respective control valves deactivation point may be in the range of about 10 to 95 psi.

In some embodiments, it may be desirous to exceed minimum activation pressure to create a functional buffer to assure ample pressure to activate the control valves because the activation pressure could increase with wear and accumulation of contamination from normal use.

Higher pressure, at the same 20 psi pressure differential between deadman supply line and control valve, will result in faster control valve deactivation time.

In embodiments, there may be a deadman/hose configuration that may include one hose used for the supply air and one for the signal. In this way, the deadman assembly may be a 3-position, 2-function pneumatic deadman configured in operable communication with a multi-hose configuration, such as a "tripleline"—a hose configured to accommodate two signals sent to an abrasive blast unit, one for each control valve, plus the supply hose.

In aspects, there may be an airline configured in a manner to connect to fittings within the deadman configured to communicate with the deadman valves. An opposite, respective end(s) of the airline may be configured to couple with the regulator and valves.

The method may include moving a lock flap movingly coupled with a frame of the deadman assembly. The lock flap may be moved from a first lock flap position to another lock flap position, such as a second or third lock flap position.

The method may include moving the trigger and the lock flap in a suitable manner whereby the trigger may engage one or both of the deadman valves.

Embodiments herein pertain to a method of high pressure spraying that may include the use of a carrier assembly, such as for holding a hose. The carrier assembly may include one or more of: a main body having a first portion movingly engaged with a second portion; there may be a first guide rail disposed on the first portion; there may be a second guide rail disposed on the second portion; a thrust management device coupled with the first guide rail, the device comprising a pad mount having a pad coupled therewith. There may be a deadman assembly coupled with the second guide rail.

There may be a latch disposed on a side of the first portion. There may be a latch slot disposed on a respective side of the second portion. The latch may have a latch end configured for engaging with the latch slot.

Embodiments of the present disclosure may pertain to a method of using or operating a high-pressure spray device that includes use of a thrust management system for a (pressurized) hose. The thrust management system may include one or more of a pad mount configured to couple with the hose; a pad backing comprising a pad backing extension. The pad mount may have a pad coupler extension. There may be a coupler having a first coupler end coupled with the pad coupler extension, and a second end coupled with the pad backing extension. There may be a pad coupled with the pad backing. The pad backing may include a thickness profile. An edge pad backing thickness may be less than a middle pad backing thickness.

The pad mount may include a first elongated portion, a second elongated portion, and one or more support members disposed therebetween.

In aspects, the first elongated portion may have a first portion longitudinal axis. The second elongated portion may have a second portion longitudinal axis. The first portion longitudinal axis and the second portion longitudinal axis may be at an offset from each other. An angle of the offset may be in a range of about −20 degrees to about 45 degrees. As an example, the range may be about 5 degrees to about 15 degrees.

A ratio of thickness of the middle pad backing thickness to the end pad backing thickness is in a range of 1.2 to 4. In some embodiments, the hose or carrier is not associated with a deadman assembly. In other embodiments, the hose or carrier is associated with a deadman assembly.

Advantages

Embodiments herein may beneficially move or transfer thrust forces to center mass of a user's body, center of gravity. The thrust pad may also be anchored to other parts of the body that can safely and comfortably sustain force. There may be significant reduction or mitigation of strain on arms and hands. Still other benefits disclosed herein may result in decreased down time due to fatigue or injury increasing productivity, as well as better control of blast hose due to less strain on the body, safety.

Embodiments herein may reduce rotational torso strain. More control of the nozzle may be achieved, as the body may be able to absorbs thrust, thereby reducing the nozzle force acting against the hands and arms allowing the nozzle/hose to be manipulated more easily.

While preferred embodiments of the disclosure have been shown and described, modifications thereof may be made by one skilled in the art without departing from the spirit and teachings of the disclosure. The embodiments described herein are exemplary only and are not intended to be limiting. Many variations and modifications of the embodiments disclosed herein are possible and are within the scope of the disclosure. Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the preferred embodiments of the present disclosure. The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

What is claimed is:

1. A carrier assembly for holding a hose comprising:

a main body comprising: a first portion; and a second portion hingedly connected with the first portion at an at least one point;

a guide rail disposed on at least one of the first portion and the second portion; and a deadman assembly coupled with the guide rail, wherein at least one of the first portion and the second portion comprise a gripper feature, wherein the first portion has a latch having a latch end configured for engaging with a latch slot of the second portion, wherein the carrier assembly is movable between an open position and a closed position, and wherein when the carrier assembly is disposed on and around the hose, a pin is used to keep the carrier assembly in the closed position around the hose.

2. The carrier assembly of claim 1, wherein the gripper feature comprises a gripper insert.

3. The carrier assembly of claim 1, wherein at least one of the first portion and the second portion comprise an underside surface configured with an insert receptacle, wherein the gripper feature is disposed in the insert receptacle, and wherein the gripper feature comprises a gripper insert.

4. The carrier assembly of claim 1, the carrier assembly further comprising a thrust management device.

5. The carrier assembly of claim 1, wherein the latch comprises a rigid latch, and wherein the gripper feature comprises a wear indicator surface.

6. The carrier assembly of claim 1, wherein the latch comprises an elastic latch that further comprises a latch spring having a spring end configured with the pin configured to engage the latch slot, and wherein the latch slot comprises a T-slot.

7. The carrier assembly of claim 1, wherein when the carrier assembly is disposed on and around the hose, a nozzle holder is adjacent an end of the carrier assembly.

8. The carrier assembly of claim 7, wherein the gripper feature comprises a gripper insert engaged with an insert receptacle.

9. A carrier assembly for holding a hose comprising:

a main body comprising: a first portion; and a second portion hingedly connected with the first portion, a guide rail disposed on at least one of the first portion and the second portion;

wherein each of the first portion and the second portion comprise a respective gripper insert disposed thereon, wherein the carrier assembly is movable between an open position and a closed position wherein the carrier assembly is disposed on and around the hose, and wherein in the closed position the gripper insert is configured to allow for freedom of rotational movement between the carrier assembly and the hose positioned therein.

10. The carrier assembly of claim 9, wherein a deadman assembly is coupled with the main body.

11. The carrier assembly of claim 10, wherein the carrier assembly further comprises:

a latch disposed on a side of the first portion; and a latch slot disposed on the second portion.

12. The carrier assembly of claim 11, wherein the latch has a latch end configured for engaging with the latch slot.

13. The carrier assembly of claim 12, wherein the latch comprises a rigid latch, and wherein at least one of the respective gripper inserts comprises a wear indictor surface.

14. The carrier assembly of claim 12, wherein the latch comprises an elastic latch that further comprises a latch spring having a spring end configured with a pin configured to engage the latch slot, and wherein the latch slot comprises a T-slot.

15. The carrier assembly of claim 9, wherein the main body comprises a longitudinal body axis, wherein a secondary handle comprising a longitudinal handle axis is coupled with the guide rail, and wherein the longitudinal body axis and the longitudinal handle axis are offset to each other by an absolute reference angle of 45 degrees to 135 degrees.

16. The carrier assembly of claim 9, wherein at least one of the first portion and the second portion comprise an underside surface configured with an insert receptacle, and wherein the respective gripper feature is disposed in the insert receptacle.

17. A carrier assembly for holding a hose comprising:

a main body comprising: a first portion; and a second portion movingly engaged with the first portion;

a first guide rail disposed on the first portion;

a thrust management device coupled with the first guide rail, the device comprising a pad mount having a pad coupled therewith;

a latch disposed on a side of the first portion; and a latch slot disposed on the second portion;

wherein at least one of the first portion and the second portion is configured with an insert receptacle, wherein the carrier assembly is movable between an open position and a closed position, wherein the gripper insert comprises a rib and a wear indicator surface, wherein when the carrier assembly is disposed on and around the hose in the closed position, the rib is in contact with the hose, wherein the wear indicator surface has a top surface with a depressed depth as compared to a rib top surface of the rib, wherein a gripper insert is disposed in the insert receptacle, and wherein the latch has a latch end configured for engaging with the latch slot.

18. The carrier assembly of claim 17, the carrier assembly further comprising a deadman assembly.

19. The carrier assembly of claim 17, wherein the latch comprises a rigid latch, and wherein a nozzle holder is disposed on and around the hose, and positioned adjacent an end of the carrier assembly.

20. The carrier assembly of claim 17, wherein a deadman assembly is coupled with the second portion, wherein the first portion is hingedly connected with the second portion, and wherein a pin is used to keep the carrier assembly in the closed position.

* * * * *